US007224924B2

(12) United States Patent
Okamoto

(10) Patent No.: US 7,224,924 B2
(45) Date of Patent: May 29, 2007

(54) DEVELOPING DEVICE, IMAGE FORMING APPARATUS, IMAGE FORMING SYSTEM, AND METHOD OF MANUFACTURING DEVELOPING DEVICE

(75) Inventor: Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 143 days.

(21) Appl. No.: 11/057,039

(22) Filed: Feb. 10, 2005

(65) Prior Publication Data

US 2005/0180779 A1 Aug. 18, 2005

(30) Foreign Application Priority Data

Feb. 13, 2004 (JP) ..... 2004-037141
Feb. 13, 2004 (JP) ..... 2004-037142
Mar. 8, 2004 (JP) ..... 2004-064809

(51) Int. Cl.
*G03G 15/08* (2006.01)

(52) U.S. Cl. ..... 399/119; 399/222; 399/252; 399/279

(58) Field of Classification Search ..... 399/119, 399/120, 110, 107, 111, 222, 252, 274, 279, 399/284
See application file for complete search history.

(56) References Cited

U.S. PATENT DOCUMENTS 6,038,416 A * 3/2000 Okano et al. ..... 399/119
6,167,227 A * 12/2000 Fujita et al. ..... 399/258
6,356,730 B1 * 3/2002 Nonaka ..... 399/284
6,671,477 B2 * 12/2003 Komatsu et al. ..... 399/119 X
2005/0232646 A1 * 10/2005 Yoshizuka et al. ..... 399/119 X
2006/0051128 A1 * 3/2006 Takahata et al. ..... 399/119 X

FOREIGN PATENT DOCUMENTS

| | | |
|---|---|---|
| JP | 60-125865 | 7/1985 |
| JP | 07-325481 | 12/1995 |
| JP | 08-123192 | 5/1996 |
| JP | 11-052713 | 2/1999 |
| JP | 11-133746 | 5/1999 |
| JP | 2003-270928 | 9/2003 |
| JP | 2004-341250 A * | 12/2004 |

* cited by examiner

*Primary Examiner*—Sophia S. Chen
(74) *Attorney, Agent, or Firm*—Hogan & Hartson LLP

(57) ABSTRACT

A developing device is provided with: a developer containing section that is for containing a developer and that has a predetermined coefficient of thermal expansion; a developing roller for bearing the developer contained in the developer containing section; a roller-supporting member that is for rotatably supporting the developing roller, that has a coefficient of thermal expansion which is different from the coefficient of thermal expansion of the developer containing section, and that is structured by connecting at least three members; and a gap for preventing the roller-supporting member and the developer containing section from interfering with one another when the roller-supporting member and the developer containing section expand/contract due to a change in temperature.

24 Claims, 25 Drawing Sheets

DEVELOPING DEVICE, IMAGE FORMING APPARATUS, IMAGE FORMING SYSTEM, AND METHOD OF MANUFACTURING DEVELOPING DEVICE

CROSS-REFERENCE TO RELATED APPLICATIONS

The present application claims priority upon Japanese Patent Application No. 2004-37141 filed on Feb. 13, 2004, Japanese Patent Application No. 2004-37142 filed on Feb. 13, 2004, and Japanese Patent Application No. 2004-64809 filed on Mar. 8, 2004, which are herein incorporated by reference.

BACKGROUND OF THE INVENTION

1. Field of the Invention

The present invention relates to developing devices, image forming apparatuses, image forming systems, and methods of manufacturing developing devices.

2. Description of the Related Art (1) There are developing device that are provided with: a developer containing section for containing a developer; a developing roller for bearing the developer contained in the developer containing section; and a roller-supporting member for rotatably supporting the developing roller.

In such a developing device, the coefficient of thermal expansion of the developer containing section differs from the coefficient of thermal expansion of the roller-supporting member. Therefore, there is a difference in the amount of expansion/contraction due to a change in temperature between the developer containing section and the roller-supporting member. In view of this, the developing device is provided with a gap for preventing the roller-supporting member and the developer containing section from interfering with one another when the roller-supporting member and the developer containing section expand/contract due to a change in temperature, which is caused by the difference in the coefficient of thermal expansion between the developer containing section and the roller-supporting member. This gap is designed to have a predetermined size, taking into consideration the amount of expansion/contraction of the roller-supporting member and the developer containing section due to a change in temperature. (See, for example, JP 2003-270928A.)

However, if the roller-supporting member is formed, for example, by connecting two members, then there are cases in which the roller-supporting member is not formed in the desired size due to variations in size of those members caused by individual differences. If the roller-supporting member is formed larger than the desired size, then the developer containing section and the roller-supporting member may expand/contract and interfere with one another due to a change in temperature.

(2) Another type of developing device is provided with: a developing roller for bearing a developer; a roller-supporting member for rotatably supporting the developing roller; and a roller gear that is provided at one end of the developing roller and that is for rotating the developing roller. In such a developing device, an intermediate gear is used for transmitting a drive force from a drive source to the roller gear, and the intermediate gear is supported by a gear-supporting shaft. (See, for example, JP 2003-270928A.)

In this type of developing device, the roller-supporting member may be structured by connecting at least two members in order to support the developing roller, and screws are often used to connect these members.

In assembling such a roller-supporting member, there has been a demand for improvement in the ease of assembling the roller-supporting member from the standpoint of, for example, shortening the time required for assembly.

(3) Further, image forming apparatuses such as laser beam printers are well known in the art. Such image forming apparatuses are provided with, for example, an image bearing body for bearing a latent image, and a developing device that develops the latent image borne on the image bearing body with a developer. When the image forming apparatus receives image signals etc. from an external device such as a host computer, the developing device is positioned in a developing position which is in opposition to the image bearing body, the latent image borne on the image bearing body is developed with the developer contained in the developing device to form a developer image, the developer image is transferred onto a medium, and ultimately an image is formed on the medium.

The developing device of the type described above has, for example, a developer charging member for charging the developer borne by a developer bearing roller, a bearing-roller-supporting member that is made of metal and that is for rotatably supporting the developer bearing roller, and a charge-supporting member that is made of metal and that is for supporting the developer charging member. (See, for example, JP 2003-270928A.)

In this type of developing device, it is necessary to arrange the developer charging member in an appropriate position with respect to the developer bearing roller so as to electrically charge the developer borne by the developer bearing roller evenly. In order to arrange the developer charging member in an appropriate position with respect to the developer bearing roller, it is necessary to arrange the charge-supporting member, which supports the developer charging member, in a suitable position with respect to the bearing-roller-supporting member, which supports the developer bearing roller.

Usually, the bearing-roller-supporting member and the charge-supporting member are fastened to one another with screws. However, if the bearing-roller-supporting member and the charge-supporting member are fastened to one another with screws, then the position of the charge-supporting member with respect to the bearing-roller-supporting member may deviate from its proper position due to the turning force etc. applied to make the screw turn during fastening. In this case, the position of the developer charging member with respect to the developer bearing roller may also deviate.

SUMMARY OF THE INVENTION

The present invention has been made in light of the foregoing issues. It is an object of the present invention to achieve a developing device, an image forming apparatus, an image forming system, and a method of manufacturing a developing device, with which it is possible to form a roller-supporting member in a desired size with satisfactory precision such that the developer containing section and the roller-supporting member do not interfere with one another even when they expand/contract due to a change in temperature.

Another object of the present invention is to achieve a developing device, an image forming apparatus, and an image forming system, with which it is possible to improve the ease in assembling the roller-supporting member.

Another object of the present invention is to achieve a developing device, an image forming apparatus and an image forming system provided with such a developing device, and a method of manufacturing the developing device, with which it is possible to arrange the developer charging member in an appropriate position with respect to the developer bearing roller.

An aspect of the present invention is a developing device comprising: a developer containing section that is for containing a developer and that has a predetermined coefficient of thermal expansion; a developing roller for bearing the developer contained in the developer containing section; a roller-supporting member that is for rotatably supporting the developing roller, that has a coefficient of thermal expansion which is different from the coefficient of thermal expansion of the developer containing section, and that is structured by connecting at least three members; and a gap for preventing the roller-supporting member and the developer containing section from interfering with one another when the roller-supporting member and the developer containing section expand/contract due to a change in temperature.

Another aspect of the present invention is a developing device comprising: a developing roller for bearing a developer; a roller-supporting member that is structured by connecting at least two members and that is for rotatably supporting the developing roller; a roller gear that is provided at one end of the developing roller and that is for rotating the developing roller; an intermediate gear for transmitting a drive force from a drive source to the roller gear; and a gear-supporting shaft for rotatably supporting the intermediate gear, a screw section of the gear-supporting shaft connecting the at least two members that structure the roller-supporting member.

Another aspect of the present invention is a developing device comprising: a developer charging member for charging a developer borne by a developer bearing roller; a bearing-roller-supporting member that is made of metal and that is for rotatably supporting the developer bearing roller; and a charge-supporting member that is made of metal and that is for supporting the developer charging member, the charge-supporting member and the bearing-roller-supporting member being welded through spot welding.

Other features of the present invention will be made clear through the accompanying drawings and the following description.

DETAILED DESCRIPTION OF THE INVENTION

Figure 1:
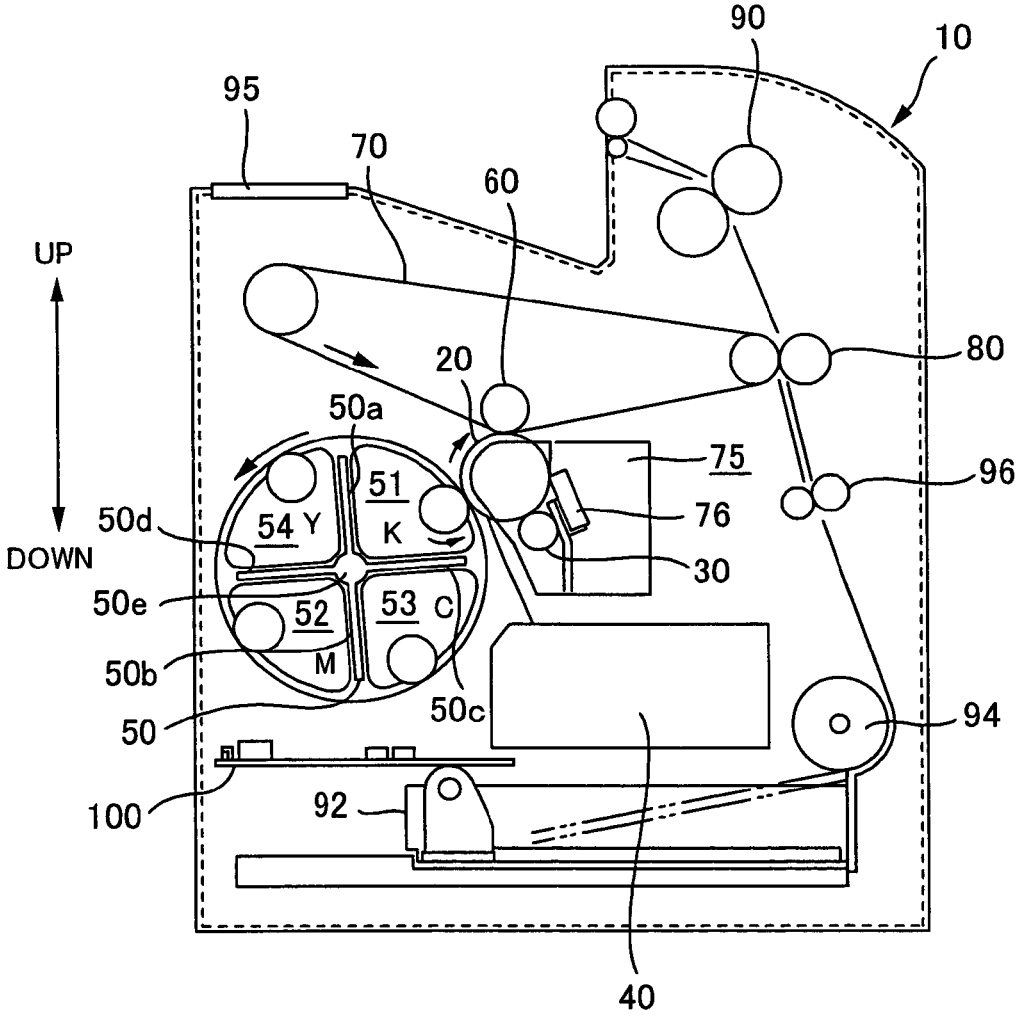
FIG. 1 is a diagram showing main structural components constructing a printer 10.

At least the following matters will become clear by the explanation in the present specification and the description of the accompanying drawings.

(1) A developing device comprises: a developer containing section that is for containing a developer and that has a predetermined coefficient of thermal expansion; a developing roller for bearing the developer contained in the developer containing section; a roller-supporting member that is for rotatably supporting the developing roller, that has a coefficient of thermal expansion which is different from the coefficient of thermal expansion of the developer containing section, and that is structured by connecting at least three members; and a gap for preventing the roller-supporting member and the developer containing section from interfering with one another when the roller-supporting member and the developer containing section expand/contract due to a change in temperature.

With this developing device, the freedom (flexibility) in assembling the roller-supporting member increases, and even when there are variations in size of the members that form the roller-supporting member due to individual differences, it becomes possible to assemble the roller-supporting member such that those variations in size of the members are absorbed. Therefore, it becomes possible to structure the roller-supporting member in a desired size with satisfactory precision.

Further, in this developing device, when the at least three members are connected to structure the roller-supporting member, a state of connection among the members may be adjusted such that the roller-supporting member has a predetermined size.

With this developing device, the state of connection among the members is adjusted such that the roller-supporting member has a predetermined size, even when there are variations in size of the members that form the roller-supporting member due to individual differences. Therefore, it becomes possible to structure the roller-supporting member in a desired size with high precision.

Further, in this developing device, the roller-supporting member may be mounted to the developer containing section such that a longitudinal direction of the roller-supporting member is arranged in a longitudinal direction of the developer containing section; and the developing device may have a gap for preventing the roller-supporting member and the developer containing section from interfering with one another when the roller-supporting member and the developer containing section expand/contract in their longitudinal direction due to a change in temperature.

The length of the roller-supporting member and the developer containing section is longer in their longitudinal direction than in their lateral direction. Therefore, the amount of expansion/contraction due to a change in temperature becomes larger in the longitudinal direction than in the lateral direction. In view of this, developing devices are often provide with a gap for preventing the roller-supporting member and the developer containing section from interfering with one another when they expand/contract in their longitudinal direction due to a change in temperature. In this way, when the roller-supporting member is structured by connecting at least three members, it becomes possible to set the length in the longitudinal direction of the roller-supporting member to a desired size such that the developer containing section and the roller-supporting member do not interfere with one another even when they expand/contract in the longitudinal direction due to a change in temperature.

Further, in this developing device, the roller-supporting member may be structured by connecting together the following four members: a first supporting member that is arranged in a lateral direction intersecting with the longitudinal direction of the roller-supporting member and that is for supporting one end of the developing roller, a second supporting member that is arranged in the lateral direction and that is for supporting the other end of the developing roller, and a first longitudinal member and a second longitudinal member that are each connected to both the first supporting member and the second supporting member and that are arranged in the longitudinal direction.

With this developing device, since the roller-supporting member is structured by connecting four members, it becomes possible to increase the freedom (flexibility) in assembling the roller-supporting member and structure the roller-supporting member such that the length in the longitudinal direction of the roller-supporting member is set to a desired size.

Further, in this developing device, the developing device may have a restriction blade for restricting a thickness of a layer of the developer borne by the developing roller; and the second longitudinal member may be a blade-supporting member for supporting the restriction blade.

It is necessary to control the position between the developing roller and the restriction blade with satisfactory precision in order to restrict the thickness of the layer of the developer borne on the developing roller. With the above structure, it is possible to structure the roller-supporting member such that the positioning between the developing roller and the restriction blade is performed with high precision when the roller-supporting member is made of four members.

Further, in this developing device, when connecting the four members, a state of connection of the first supporting member and the second supporting member with respect to the blade-supporting member may be adjusted.

With this developing device, it becomes possible to adjust the position between the developing roller and the restriction blade with even higher precision by adjusting the state of connection of the first supporting member and the second supporting member, which support the developing roller, with respect to the blade-supporting member, which supports the restriction blade.

Further, in this developing device, a roller gear for rotating the developing roller with a drive force transmitted from a drive source may be provided on the one end of the developing roller; and the gap may exist between a side surface of the second supporting member that intersects with the longitudinal direction, and an opposition surface of the developer containing section that is in opposition to the side surface.

With this developing device, the gap between the roller-supporting member and the developer containing section is provided between the side surface of the second supporting member and the opposition surface of the developer containing section, that is, on the opposite side from the driving section where the roller gear is located. Therefore, it is possible to prevent the driving section from being affected.

Further, in this developing device, the second longitudinal member and the first supporting member may be connected with a screw, the second longitudinal member and the second supporting member may be connected with a screw, and the first supporting member and the first longitudinal member may be connected with a screw; and the second supporting member and first longitudinal member do not have to be connected with a screw.

With this developing device, even when the second supporting member and first longitudinal member are not connected with a screw, the second longitudinal member and the first supporting member, the second longitudinal member and the second supporting member, and the first supporting member and the first longitudinal member are connected with screws, respectively. Therefore, the function of the roller-supporting member, which is to support the developing roller, can be achieved. Further, by not connecting the second supporting member and first longitudinal member with a screw, the time required for assembling the roller-supporting member can be shortened.

Further, in this developing device, a projection may be provided at an end of the first longitudinal member that is connected to the second supporting member; a hole may be provided in the second supporting member; and the projection may be fitted into the hole.

With this developing device, it becomes possible to set the length in the longitudinal direction of the roller-supporting member to a desired size, even when there are variations in size in the longitudinal direction of the first longitudinal member due to individual differences.

Further, in this developing device, the developer containing section may be made of resin, and the roller-supporting member may be made of metal.

Often, the developer containing section is made of resin to achieve weight reduction, and the roller-supporting member is made of metal to hold the developing roller reliably. However, the difference in the coefficient of thermal expansion between resin and metal is larger than the difference in the coefficient of thermal expansion between two resin components. Therefore, the resin-made developer containing section and the metal-made roller-supporting member are more likely to interfere with one another due to a change in temperature. Thus, the effect of the present invention, i.e., the effect of allowing the roller-supporting member to be structured in a desired size, is achieved more advantageously.

It is also possible to achieve a developing device comprising: a developer containing section that is for containing a developer and that has a predetermined coefficient of thermal expansion; a developing roller for bearing the developer contained in the developer containing section; a roller-supporting member that is for rotatably supporting the developing roller, that has a coefficient of thermal expansion which is different from the coefficient of thermal expansion of the developer containing section, and that is structured by connecting at least three members; and a gap for preventing the roller-supporting member and the developer containing section from interfering with one another when the roller-supporting member and the developer containing section expand/contract due to a change in temperature; wherein, when the at least three members are connected to structure the roller-supporting member, a state of connection among the members is adjusted such that the roller-supporting member has a predetermined size; wherein the roller-supporting member is mounted to the developer containing section such that a longitudinal direction of the roller-supporting member is arranged in a longitudinal direction of the developer containing section; wherein the developing device has a gap for preventing the roller-supporting member and the developer containing section from interfering with one another when the roller-supporting member and the developer containing section expand/contract in their longitudinal direction due to a change in temperature; wherein the roller-supporting member is structured by connecting together the following four members: a first supporting member that is arranged in a lateral direction intersecting with the longitudinal direction of the roller-supporting member and that is for supporting one end of the developing roller, a second supporting member that is arranged in the lateral direction and that is for supporting the other end of the developing roller, and a first longitudinal member and a second longitudinal member that are each connected to both the first supporting member and the second supporting member and that are arranged in the longitudinal direction; wherein the developing device has a restriction blade for restricting a thickness of a layer of the developer borne by the developing roller; wherein the second longitudinal member is a blade-supporting member for supporting the restriction blade; wherein, when connecting the four members, a state of connection of the first supporting member and the second supporting member with respect to the blade-supporting member is adjusted; wherein a roller gear for rotating the developing roller with a drive force transmitted from a drive source is provided on the one end of the developing roller; wherein the gap exists between a side surface of the second supporting member that intersects with the longitudinal direction, and an opposition surface of the developer containing section that is in opposition to the side surface; wherein the second longitudinal member and the first supporting member are connected with a screw, the second longitudinal member and the second supporting member are connected with a screw, and the first supporting member and the first longitudinal member are connected with a screw; wherein the second supporting member and first longitudinal member are not connected with a screw; wherein a projection is provided at an end of the first longitudinal member that is connected to the second supporting member; wherein a hole is provided in the second supporting member; wherein the projection is fitted into the hole; and wherein the developer containing section is made of resin, and the roller-supporting member is made of metal.

With this developing device, the effect of allowing the roller-supporting member to be structured in a desired size with satisfactory precision is achieved most advantageously.

It is also possible to achieve an image forming apparatus comprising: an image bearing body for bearing a latent image; and a developing device provided with: a developer containing section that is for containing a developer and that has a predetermined coefficient of thermal expansion; a developing roller for bearing the developer contained in the developer containing section, the developer borne by the developing roller being used to develop the latent image borne by the image bearing body; a roller-supporting member that is for rotatably supporting the developing roller, that has a coefficient of thermal expansion which is different from the coefficient of thermal expansion of the developer containing section, and that is structured by connecting at least three members; and a gap for preventing the roller-supporting member and the developer containing section from interfering with one another when the roller-supporting member and the developer containing section expand/contract due to a change in temperature.

In this way, an image forming apparatus that is superior to conventional apparatuses can be achieved because it is provided with a developing device with which it is possible to structure the roller-supporting member in a desired size with satisfactory precision.

It is also possible to achieve an image forming system comprising: a computer; and an image forming apparatus that is connectable to the computer and that has an image bearing body for bearing a latent image, and a developing device provided with: a developer containing section that is for containing a developer and that has a predetermined coefficient of thermal expansion; a developing roller for bearing the developer contained in the developer containing section, the developer borne by the developing roller being used to develop the latent image borne by the image bearing body; a roller-supporting member that is for rotatably supporting the developing roller, that has a coefficient of thermal expansion which is different from the coefficient of thermal expansion of the developer containing section, and that is structured by connecting at least three members; and a gap for preventing the roller-supporting member and the developer containing section from interfering with one another when the roller-supporting member and the developer containing section expand/contract due to a change in temperature.

In this way, an image forming system that is superior to conventional systems can be achieved because it is provided with a developing device with which it is possible to structure the roller-supporting member in a desired size with satisfactory precision.

It is also possible to achieve a method of manufacturing a developing device that is provided with: a developer containing section that is for containing a developer and that has a predetermined coefficient of thermal expansion; a developing roller for bearing the developer contained in the developer containing section; a roller-supporting member that is for rotatably supporting the developing roller and that has a coefficient of thermal expansion which is different from the coefficient of thermal expansion of the developer containing section; and a gap for preventing the roller-supporting member and the developer containing section from interfering with one another when the roller-supporting member and the developer containing section expand/contract due to a change in temperature, the method comprising: preparing at least three members for structuring the roller-supporting member; and connecting the at least three members while adjusting a state of connection among the members such that the roller-supporting member has a predetermined size.

With this method of manufacturing a developing device, it is possible to manufacture a developing device with which it is possible to structure the roller-supporting member in a desired size with satisfactory precision.

(2) Further, a developing device comprises: a developing roller for bearing a developer; a roller-supporting member that is structured by connecting at least two members and that is for rotatably supporting the developing roller; a roller gear that is provided at one end of the developing roller and that is for rotating the developing roller; an intermediate gear for transmitting a drive force from a drive source to the roller gear; and a gear-supporting shaft for rotatably supporting the intermediate gear, a screw section of the gear-supporting shaft connecting the at least two members that structure the roller-supporting member.

With this developing device, it is possible to improve the ease in assembling the roller-supporting member because the gear-supporting shaft also serves as a screw.

Further, in this developing device, one of the two members may be a one-end supporting member for rotatably supporting, through a bearing, the one end of the developing roller; and the one-end supporting member may be provided with a shaft hole for mating with the gear-supporting shaft and a bearing hole for mating with the bearing.

With this developing device, the positions where the gear-supporting shaft and the bearing are mated with the one-end supporting member can be kept constant. In this way, the distance between the intermediate gear supported by the gear-supporting shaft and the roller gear supported by the developing roller that mates with the bearing can be set to a constant value. Therefore, it becomes possible to control the distance between the intermediate gear and the roller gear with high precision.

Further, in this developing device, the intermediate gear may mesh with the roller gear.

With this developing device, it is possible to transmit the drive force from the intermediate gear to the roller gear properly when the distance between the intermediate gear and the roller gear is controlled with higher precision.

Further, in this developing device, the two members may be: the one-end supporting member, and a longitudinal member that is arranged in a longitudinal direction of the developing roller and that is connected to the one-end supporting member; the gear-supporting shaft may be provided with: a first shaft section for rotatably supporting the intermediate gear, a second shaft section whose diameter is smaller than a diameter of the first shaft section, and the screw section whose diameter is smaller than the diameter of the second shaft section and on which a male screw is formed; the longitudinal member may have a female screw formed therein; and the one-end supporting member and the longitudinal member may be connected by fitting the male screw into the female screw in a state where the second shaft section is fitted into the shaft hole.

With this developing device, the one-end supporting member and the longitudinal member are connected by fitting the male screw into the female screw in a state where the second shaft section is fitted into the shaft hole. Therefore, it becomes possible to reliably connect the one-end supporting member and the longitudinal member with a simple structure.

Further, in this developing device, the intermediate gear may rotate in a predetermined direction; and a winding direction of a thread of the male screw may be arranged in such a direction that the one-end supporting member and the longitudinal member are tightened together when the gear-supporting shaft is rotated in the predetermined direction.

With this developing device, it becomes possible to prevent the male screw of the screw section from loosening from the female screw of the longitudinal member.

Further, in this developing device, the developing device may have: a developer containing section for containing a developer, and a sealing member that abuts against the developing roller and that is for preventing the developer from spilling from between the developing roller and the developer containing section; and the sealing member may be supported by the longitudinal member.

By fitting the male screw of the gear-supporting shaft, which is supported at a predetermined position with respect to the one-end supporting member through mating of the second shaft section and the shaft hole, into the female screw of the longitudinal member, it is possible to control the attachment position of the longitudinal member with respect to the one-end supporting member with satisfactory precision. In this case, it is possible to properly control the abutment of the sealing member against the developing roller when the sealing member is supported by the longitudinal member, and therefore effectively prevent the developer from spilling from between the developing roller and the developer containing section.

Further, in this developing device, the roller-supporting member may be structured by connecting together the following four members: the one-end supporting member, an other-end supporting member for rotatably supporting, through a bearing, an other end of the developing roller, and the longitudinal member and a second longitudinal member that are each connected to both the one-end supporting member and the other-end supporting member and that are arranged in the longitudinal direction.

There are cases in which the roller-supporting member is structured of four members in order to rotatably support the developing roller at both ends. In this case, screws are often used to connect the four members, and thus, assembly of the roller-supporting member may become more complicated. If two members that structure the roller-supporting member are connected using a screw section of the gear-supporting shaft, then the effect of allowing improvement in the ease in assembling the roller-supporting member is achieved more advantageously.

It is also possible to achieve a developing device comprising: a developing roller for bearing a developer; a roller-supporting member that is structured by connecting at least two members and that is for rotatably supporting the developing roller; a roller gear that is provided at one end of the developing roller and that is for rotating the developing roller; an intermediate gear for transmitting a drive force from a drive source to the roller gear; and a gear-supporting shaft for rotatably supporting the intermediate gear, a screw section of the gear-supporting shaft connecting the at least two members that structure the roller-supporting member; wherein one of the two members is a one-end supporting member for rotatably supporting, through a bearing, the one end of the developing roller; wherein the one-end supporting member is provided with a shaft hole for mating with the gear-supporting shaft and a bearing hole for mating with the bearing; wherein the intermediate gear meshes with the roller gear; wherein the two members are: the one-end supporting member, and a longitudinal member that is arranged in a longitudinal direction of the developing roller and that is connected to the one-end supporting member; wherein the gear-supporting shaft is provided with: a first shaft section for rotatably supporting the intermediate gear, a second shaft section whose diameter is smaller than a diameter of the first shaft section, and the screw section whose diameter is smaller than the diameter of the second shaft section and on which a male screw is formed; wherein the longitudinal member has a female screw formed therein; wherein the one-end supporting member and the longitudinal member are connected by fitting the male screw into the female screw in a state where the second shaft section is fitted into the shaft hole; wherein the intermediate gear rotates in a predetermined direction; wherein a winding direction of a thread of the male screw is arranged in such a direction that the one-end supporting member and the longitudinal member are tightened together when the gear-supporting shaft is rotated in the predetermined direction; wherein the developing device has: a developer containing section for containing a developer, and a sealing member that abuts against the developing roller and that is for preventing the developer from spilling from between the developing roller and the developer containing section; wherein the sealing member is supported by the longitudinal member; and wherein the roller-supporting member is structured by connecting together the following four members: the one-end supporting member, an other-end supporting member for rotatably supporting, through a bearing, an other end of the developing roller, and the longitudinal member and a second longitudinal member that are each connected to both the one-end supporting member and the other-end supporting member and that are arranged in the longitudinal direction.

With this developing device, the effect of allowing improvement in the ease in assembling the roller-supporting member is achieved most advantageously.

It is also possible to achieve an image forming apparatus comprising: an image bearing body for bearing a latent image; and a developing device provided with: a developing roller for bearing a developer, the developer borne by the developing roller being used to develop the latent image borne by the image bearing body; a roller-supporting member that is structured by connecting at least two members and that is for rotatably supporting the developing roller; a roller gear that is provided at one end of the developing roller and that is for rotating the developing roller; an intermediate gear for transmitting a drive force from a drive source to the roller gear; and a gear-supporting shaft for rotatably supporting the intermediate gear, a screw section of the gear-supporting shaft connecting the at least two members that structure the roller-supporting member.

In this way, an image forming apparatus that is superior to conventional apparatuses can be achieved because it is provided with a developing device with which it is possible to improve the ease in assembling the roller-supporting member.

It is also possible to achieve an image forming system comprising: a computer; and an image forming apparatus that is connectable to the computer and that has an image bearing body for bearing a latent image, and a developing device provided with: a developing roller for bearing a developer, the developer borne by the developing roller being used to develop the latent image borne by the image bearing body; a roller-supporting member that is structured by connecting at least two members and that is for rotatably supporting the developing roller; a roller gear that is provided at one end of the developing roller and that is for rotating the developing roller; an intermediate gear for transmitting a drive force from a drive source to the roller gear; and a gear-supporting shaft for rotatably supporting the intermediate gear, a screw section of the gear-supporting shaft connecting the at least two members that structure the roller-supporting member.

In this way, an image forming system that is superior to conventional systems can be achieved because it is provided with a developing device with which it is possible to improve the ease in assembling the roller-supporting member.

(3) Further, a developing device comprises: a developer charging member for charging a developer borne by a developer bearing roller; a bearing-roller-supporting member that is made of metal and that is for rotatably supporting the developer bearing roller; and a charge-supporting member that is made of metal and that is for supporting the developer charging member, the charge-supporting member and the bearing-roller-supporting member being welded through spot welding.

With this developing device, since it is possible to prevent the position of the charge-supporting member with respect to the bearing-roller-supporting member from deviating from its proper position when welding together the bearing-roller-supporting member and the charge-supporting member, it becomes possible to arrange the developer charging member in an appropriate position with respect to the developer bearing roller.

Further, in this developing device, the spot welding may be laser spot welding.

In this way, since it is possible to control the intensity of the laser beam and the irradiation time easily and therefore keep unnecessary heat from being applied to the bearing-roller-supporting member and the charge-supporting member, deformation of the bearing-roller-supporting member and the charge-supporting member due to heat can be inhibited. Thus, it becomes possible to prevent the deviation in position of the charge-supporting member with respect to the bearing-roller-supporting member more effectively.

Further, in this developing device, an attachment position where the charge-supporting member is attached to the bearing-roller-supporting member may be adjusted, and after adjusting the attachment position, the charge-supporting member and the bearing-roller-supporting member may be welded through spot welding.

In this way, it is possible to prevent the position of the charge-supporting member with respect to the bearing-roller-supporting member from deviating after the attachment position has been adjusted, and therefore arrange the developer charging member in a more appropriate position with respect to the developer bearing roller.

Further, in this developing device, the bearing-roller-supporting member may include a one-end supporting member for rotatably supporting one end, in an axial direction, of the developer bearing roller, and an other-end supporting member for rotatably supporting an other end, in the axial direction, of the developer bearing roller; the charge-supporting member may be provided such that a longitudinal direction thereof is arranged in the axial direction of the developer bearing roller; and the charge-supporting member and both the one-end supporting member and the other-end supporting member may be welded through spot welding.

In this way, it is possible to prevent the position of the charge-supporting member with respect to the one-end supporting member and the other-end supporting member from deviating, and therefore arrange the developer charging member in a more appropriate position with respect to the developer bearing roller.

Further, in this developing device, both ends, in the longitudinal direction, of the charge-supporting member may be bent; and the sections that have been bent may be welded, respectively, through spot welding to the one-end supporting member and the other-end supporting member in a state where the sections that have been bent are placed in contact, respectively, with the one-end supporting member and the other-end supporting member.

In a case where the sections on both ends of the charge-supporting member that have been bent and the bearing-roller-supporting member are fastened together with a screw, the position of the charge-supporting member with respect to the bearing-roller-supporting member is more likely to deviate from its proper position due to the turning force etc. for causing the screw to turn. Therefore, the effect of the present invention, i.e., the effect of allowing the developer charging member to be arranged in an appropriate position with respect to the developer bearing roller, is achieved more advantageously.

Further, in this developing device, the developer charging member may be provided with an abutting section that abuts against the developer bearing roller.

In a case where the abutting section is provided on the developer charging member, it is necessary to arrange the abutting section in an appropriate position with respect to the developer bearing roller to make the electric charge of the developer on the developer bearing roller even. Therefore, the effect of the present invention, i.e., the effect of allowing the developer charging member to be arranged in an appropriate position with respect to the developer bearing roller, is achieved more advantageously.

Further, in this developing device, the developer charging member may be provided with an abutment-supporting section whose one end, in a lateral direction, is supported by the charge-supporting member and whose other end is for supporting the abutting section; and the abutment-supporting section and the charge-supporting member may be welded through spot welding.

In this case, since the bearing-roller-supporting member and the charge-supporting member, as well as the abutment-supporting section and the charge-supporting member, are welded through the same spot welding technique, the burden of changing the method for welding can be eliminated, and therefore, it becomes possible to improve the workability during manufacturing.

Further, in this developing device, the developing device may have a seal-supporting member for supporting a sealing member that prevents the developer from spilling from between the developer bearing roller and a housing that contains the developer; and the seal-supporting member and both the one-end supporting member and the other-end supporting member may be welded through spot welding.

In this case, since the charge-supporting member and the seal-supporting member are connected to both the one-end supporting member and the other-end supporting member through spot welding, it becomes possible to increase the strength in connecting the four members.

It is also possible to achieve a developing device comprising: a developer charging member for charging a developer borne by a developer bearing roller; a bearing-roller-supporting member that is made of metal and that is for rotatably supporting the developer bearing roller; and a charge-supporting member that is made of metal and that is for supporting the developer charging member; wherein an attachment position where the charge-supporting member is attached to the bearing-roller-supporting member is adjusted, and after adjusting the attachment position, the charge-supporting member and the bearing-roller-supporting member are welded through laser spot welding; wherein the bearing-roller-supporting member includes a one-end supporting member for rotatably supporting one end, in an axial direction, of the developer bearing roller, and an other-end supporting member for rotatably supporting an other end, in the axial direction, of the developer bearing roller; wherein the charge-supporting member is provided such that a longitudinal direction thereof is arranged in the axial direction of the developer bearing roller; wherein the charge-supporting member and both the one-end supporting member and the other-end supporting member are welded through laser spot welding; wherein both ends, in the longitudinal direction, of the charge-supporting member are bent; wherein the sections that have been bent are welded, respectively, through laser spot welding to the one-end supporting member and the other-end supporting member in a state where the sections that have been bent are placed in contact, respectively, with the one-end supporting member and the other-end supporting member; wherein the developer charging member is provided with an abutting section that abuts against the developer bearing roller; wherein the developer charging member is provided with an abutment-supporting section whose one end, in a lateral direction, is supported by the charge-supporting member and whose other end is for supporting the abutting section; wherein the abutment-supporting section and the charge-supporting member are welded through laser spot welding; wherein the developing device has a seal-supporting member for supporting a sealing member that prevents the developer from spilling from between the developer bearing roller and a housing that contains the developer; and wherein the seal-supporting member and both the one-end supporting member and the other-end supporting member are welded through laser spot welding.

With this developing device, the effect of allowing the developer charging member to be arranged in an appropriate position with respect to the developer bearing roller is achieved most advantageously.

It is also possible to achieve an image forming apparatus comprising: an image bearing body for bearing a latent image; and a developing device provided with: a developer charging member for charging a developer borne by a developer bearing roller, the developer borne by the developer bearing roller being used to develop the latent image borne by the image bearing body; a bearing-roller-supporting member that is made of metal and that is for rotatably supporting the developer bearing roller; and a charge-supporting member that is made of metal and that is for supporting the developer charging member, the charge-supporting member and the bearing-roller-supporting member being welded through spot welding.

In this way, an image forming apparatus that is superior to conventional apparatuses can be achieved because it is provided with a developing device with which it is possible to arrange the developer charging member in an appropriate position with respect to the developer bearing roller.

It is also possible to achieve an image forming system comprising: a computer; and an image forming apparatus that is connectable to the computer and that has an image bearing body for bearing a latent image, and a developing device provided with: a developer charging member for charging a developer borne by a developer bearing roller, the developer borne by the developer bearing roller being used to develop the latent image borne by the image bearing body; a bearing-roller-supporting member that is made of metal and that is for rotatably supporting the developer bearing roller; and a charge-supporting member that is made of metal and that is for supporting the developer charging member, the charge-supporting member and the bearing-roller-supporting member being welded through spot welding.

In this way, an image forming system that is superior to conventional systems can be achieved because it is provided with a developing device with which it is possible to arrange the developer charging member in an appropriate position with respect to the developer bearing roller.

It is also possible to achieve a method of manufacturing a developing device, comprising: supporting a developer charging member with a charge-supporting member, the developer charging member being provided for charging a developer borne by a developer bearing roller, and the charge-supporting member being made of metal and provided for supporting the developer charging member; adjusting an attachment position where the charge-supporting member, which supports the developer charging member, is attached to a bearing-roller-supporting member that is made of metal and that is provided for rotatably supporting the developer bearing roller; and after adjusting the attachment position, welding the bearing-roller-supporting member and the charge-supporting member through spot welding.

With this method of manufacturing a developing device, it is possible to arrange the developer charging member in an appropriate position with respect to the developer bearing roller.

Further, in this method of manufacturing a developing device, the spot welding may be laser spot welding.

In this way, since it is possible to control the intensity of the laser beam and the irradiation time easily and therefore keep unnecessary heat from being applied to the bearing-roller-supporting member and the charge-supporting member, deformation of the bearing-roller-supporting member and the charge-supporting member due to heat can be inhibited. Thus, it becomes possible to prevent the deviation in position of the charge-supporting member with respect to the bearing-roller-supporting member more effectively.

Further, in this method of manufacturing a developing device, the bearing-roller-supporting member may include a one-end supporting member for rotatably supporting one end, in an axial direction, of the developer bearing roller, and an other-end supporting member for rotatably supporting an other end, in the axial direction, of the developer bearing roller; the charge-supporting member may be provided such that a longitudinal direction thereof is arranged in the axial direction of the developer bearing roller; both ends, in the longitudinal direction, of the charge-supporting member may be bent; and in the step of welding the bearing-roller-supporting member and the charge-supporting member through spot welding, the sections that have been bent may be welded, respectively, through spot welding to the one-end supporting member and the other-end supporting member in a state where the sections that have been bent are placed in contact, respectively, with the one-end supporting member and the other-end supporting member.

In a case where the sections on both ends of the charge-supporting member that have been bent and the bearing-roller-supporting member are fastened together with a screw, the position of the charge-supporting member with respect to the bearing-roller-supporting member is more likely to deviate from its proper position due to the turning force etc. for causing the screw to turn. Therefore, the effect of the present invention, i.e., the effect of allowing the developer charging member to be arranged in an appropriate position with respect to the developer bearing roller, is achieved more advantageously.

Further, in this method of manufacturing a developing device, the developer charging member and the charge-supporting member may be welded through spot welding in the step of supporting the developer charging member with the charge-supporting member.

In this case, since the bearing-roller-supporting member and the charge-supporting member, as well as the developer charging member and the charge-supporting member, are welded through the same spot welding technique, the burden of changing the method for welding can be eliminated, and therefore, it becomes possible to improve the workability during manufacturing.

Further, in this method of manufacturing a developing device, the developer charging member may be provided with an abutting section that abuts against the developer bearing roller; the bearing-roller-supporting member may be provided with a roller-supporting hole for supporting the developer bearing roller; and in the step of adjusting the attachment position, the attachment position may be adjusted such that a distance between an end of the abutting section and a center of the roller-supporting hole takes a predetermined value.

In this way, it becomes possible to arrange the charge-supporting member in an appropriate position with respect to the bearing-roller-supporting member with higher precision compared to adjusting the attachment position in a state where the abutting section is made to abut against the developer bearing roller.

<<<Overview of Image Forming Apparatus (Laser Beam Printer)>>>

Next, using FIG. 1, an outline of a laser beam printer 10 (referred to also as "printer 10" below), which is an example of an image forming apparatus, is described. FIG. 1 is a diagram showing main structural components constructing the printer 10. It should be noted that in FIG. 1, the vertical direction is shown by the arrow, and, for example, a paper supply tray 92 is arranged at a lower section of the printer 10, and a fusing unit 90 is arranged at an upper section of the printer 10.

<Overall Configuration of Image Forming Apparatus>

As shown in FIG. 1, the printer 10 according to the present embodiment includes a charging unit 30, an exposing unit 40, a rotating body 50, a first transferring unit 60, an intermediate transferring body 70, and a cleaning unit 75. These units are arranged in the direction of rotation of a photoconductor 20, which serves as an example of an image bearing body for bearing a latent image. The printer 10 further includes a second transferring unit 80, a fusing unit 90, a displaying unit 95 constructed of a liquid-crystal panel and serving as means for making notifications to the user etc., and a control unit 100 for controlling these units etc. and managing the operations as a printer.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow in FIG. 1.

The charging unit 30 is a device for charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 according to image signals having been input from a not-shown host computer such as a personal computer or a word processor.

The rotating body 50 is a device for developing the latent image formed on the photoconductor 20 using black (K) toner contained in a black developing unit 51, magenta (M) toner contained in a magenta developing unit 52, cyan (C) toner contained in a cyan developing unit 53, and yellow (Y) toner contained in a yellow developing unit 54 (3054 in the third embodiment).

In the present embodiment, the rotating body 50 rotates to allow the positions of the four developing units 51, 52, 53, and 54 (3054), which serve as an example of developing devices, to, be moved. More specifically, the rotating body 50 holds the four developing units 51, 52, 53, and 54 (3054) with four attach/detach sections 50*a*, 50*b*, 50*c*, and 50*d*, respectively, and the four developing units 51, 52, 53, and 54 (3054) can be rotated about a rotating shaft 50*e* while maintaining their relative positions. A different one of the developing units is made to selectively oppose the photoconductor 20 each time the photoconductor 20 makes one revolution, thereby successively developing the latent image formed on the photoconductor 20 using the toner T, which is an example of a developer, contained in each of the developing units 51, 52, 53, and 54 (3054). It should be noted that details on the developing units are described further below.

The first transferring unit 60 is a device for transferring, onto the intermediate transferring body 70, a single-color toner image formed on the photoconductor 20. When toner images of four colors are successively transferred in a superposed manner, a full-color toner image is formed on the intermediate transferring body 70. The intermediate transferring body 70 is an endless belt that is driven to rotate at substantially the same circumferential speed as the photoconductor 20. The second transferring unit 80 is a device for transferring the single-color toner image, or the full-color toner image, formed on the intermediate transferring body 70 onto a recording medium such as paper, film, and cloth.

The fusing unit 90 is a device for fusing the single-color toner image or the full-color toner image, which has been transferred to the recording medium, onto the recording medium such as paper to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner remaining on the photoconductor 20 by scraping it off with the cleaning blade 76 after the toner image has been transferred on to the intermediate transferring body 70 by the first transferring unit 60.

Figure 2:
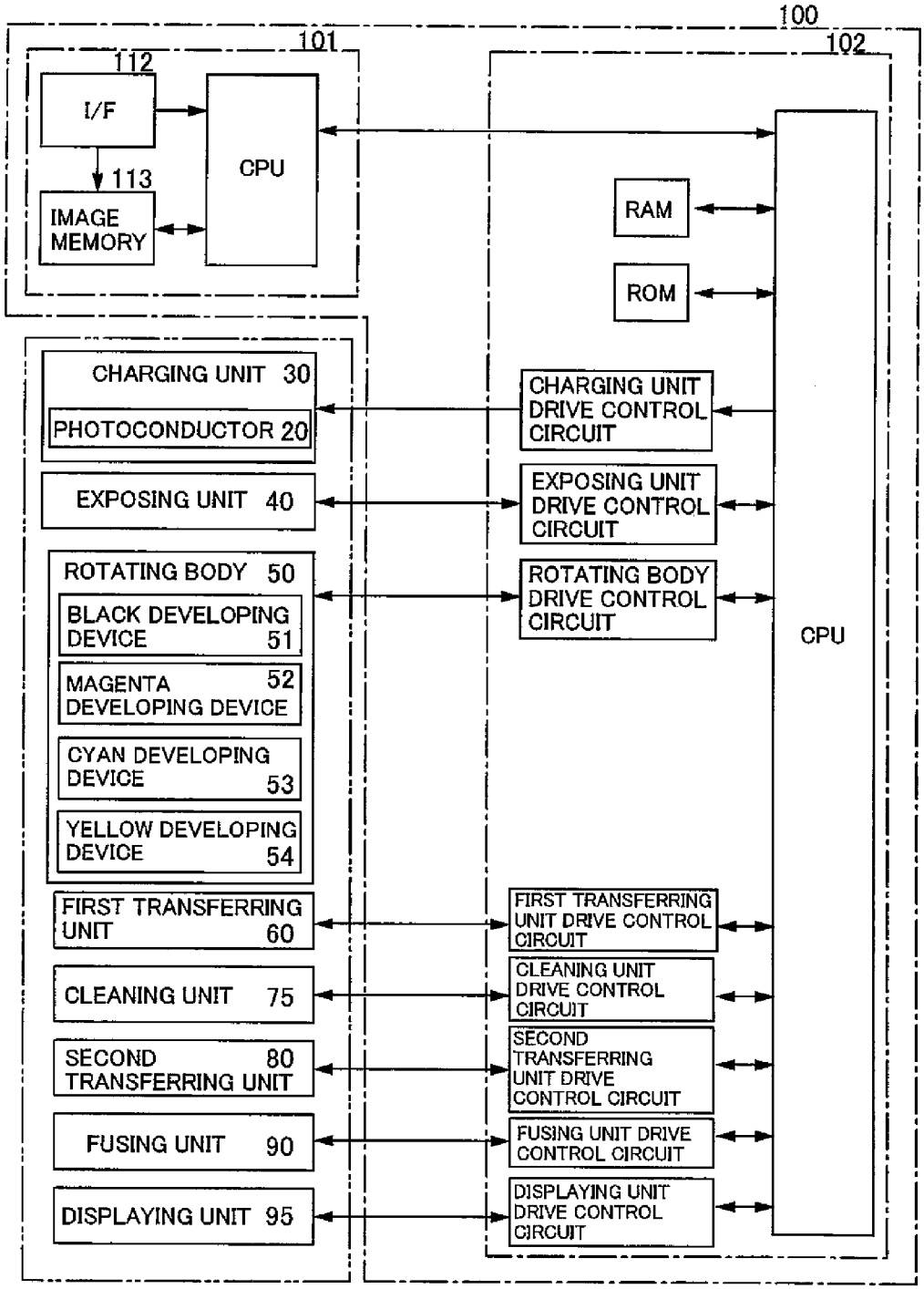
FIG. 2 is a block diagram showing a control unit of the printer 10.

The control unit 100 includes a main controller 101 and a unit controller 102 as shown in FIG. 2. Image signals are input to the main controller 101, and according to instructions based on these image signals, the unit controller 102 controls each of the above-mentioned units etc. to form an image.

<Operation of Image Forming Apparatus>

Next, operations of the printer 10 structured as above are described, referring also to other structural components.

When image signals are input from the not-shown host computer to the main controller 101 of the printer 10 through an interface (I/F) 112, then the photoconductor 20, a developing roller, which is provided in each of the developing units 51, 52, 53, and 54 (3054), and the intermediate transferring body 70 rotate under the control of the unit controller 102 according to the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information for the first color, for example, yellow Y, is formed in that area by the exposing unit 40. The rotating body 50 positions the yellow developing unit 54 (3054), which contains yellow (Y) toner, at the developing position opposing the photoconductor 20.

With the rotation of the photoconductor 20, the latent image formed on the photoconductor 20 reaches the developing position, and is developed with the yellow toner by the yellow developing unit 54 (3054). Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner is charged, is applied to the first transferring unit 60. It should be noted that, during this process, the second transferring unit 80 is kept separated from the intermediate transferring body 70.

By repeating the above-mentioned processes for the second, the third, and the fourth colors, toner images in four colors corresponding to the respective image signals are transferred to the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a recording medium by the second transferring unit 80. It should be noted that the recording medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the recording medium is heated and pressurized by the fusing unit 90 and fused to the recording medium.

On the other hand, after the photoconductor 20 passes the first transferring position, the toner adhering to the surface of the photoconductor 20 is scraped off by the cleaning blade 76 that is supported on the cleaning unit 75, and the photoconductor 20 is prepared for charging for the next latent image to be formed. The scraped-off toner is collected into a remaining-toner collector of the cleaning unit 75.

<<<Overview of Control Unit>>>

Next, a configuration of the control unit 100 is described with reference to FIG. 2. The main controller 101 of the control unit 100 is connected to a host computer via the interface 112, and is provided with an image memory 113 for storing the image signals that have been input from the host computer.

The unit controller 102 is electrically connected to the units in the body of the apparatus (i.e., the charging unit 30, the exposing unit 40, the rotating body 50, the first transferring unit 60, the cleaning unit 75, the second transferring unit 80, the fusing unit 90, and the displaying unit 95), and it detects the state of the units by receiving signals from sensors provided in those units, and controls them based on the signals that are input from the main controller 101.

<<<First Embodiment>>>

===(1) Overview of Developing Unit===

Figure 3:
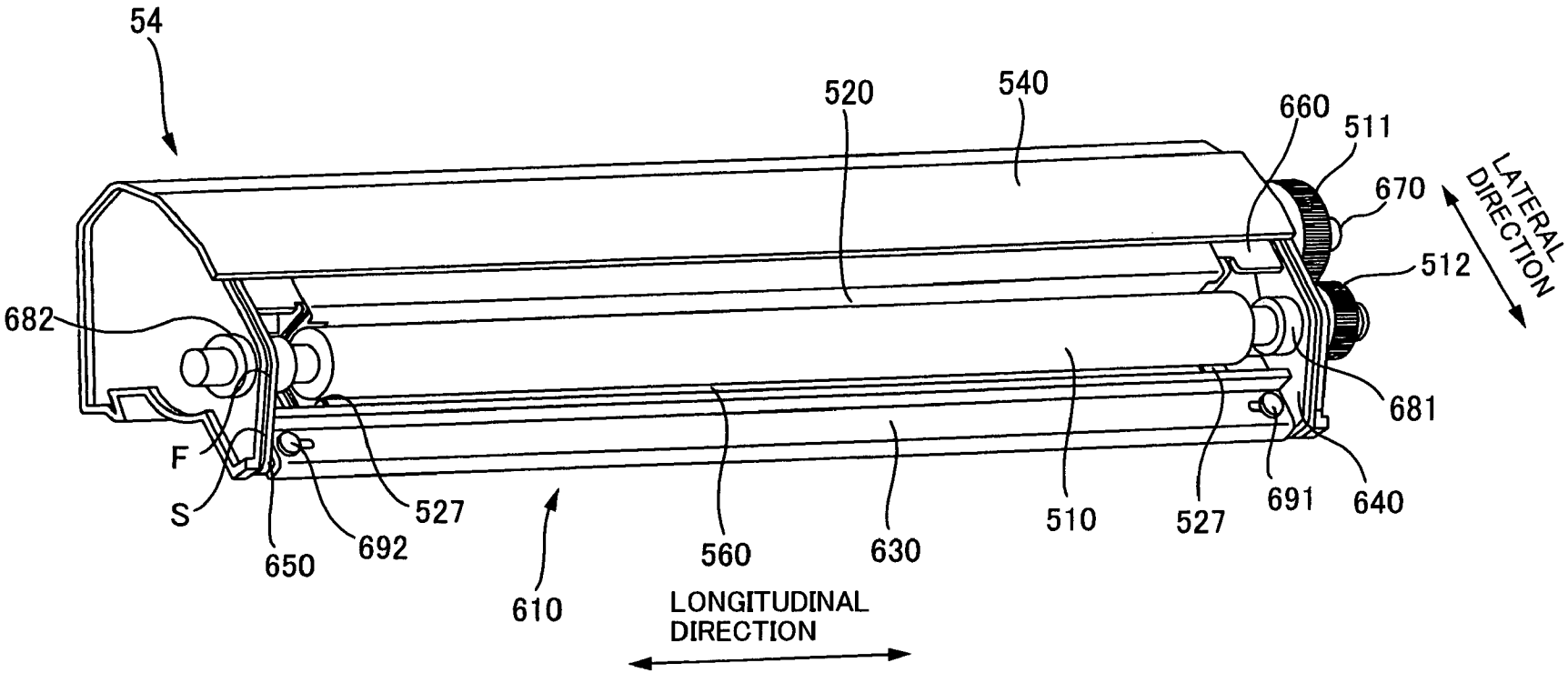
FIG. 3 is a perspective view of a developing unit 54.
Figure 4:
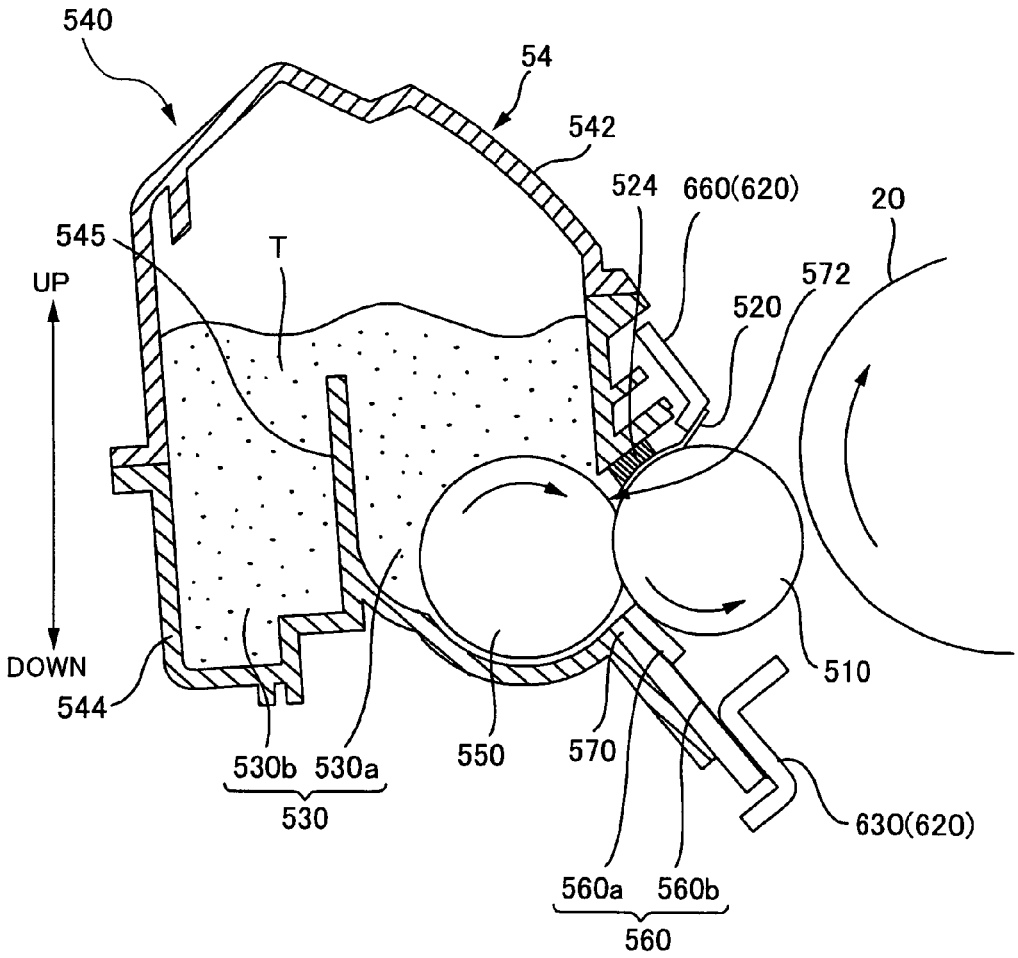
FIG. 4 is a section view showing main structural components of the developing unit 54.

Next, using FIG. 3 and FIG. 4, an example of a configuration of a developing unit according to a first embodiment will be described. It should be noted that the configuration of the overall image forming apparatus and the configuration of the control unit are the same for the present first embodiment and the second and third embodiments described later on. FIG. 3 is a perspective view of a developing unit 54. FIG. 4 is a section view showing main structural components of the developing unit 54. It should be noted that the section view shown in FIG. 4 is a cross section of the developing unit 54 bisected by a plane perpendicular to the longitudinal direction shown in FIG. 3. Further, in FIG. 4, the arrow indicates the vertical direction as in FIG. 1, and, for example, the central axis of the developing roller 510 is located below the central axis of the photoconductor 20. Further, in FIG. 4, the yellow developing unit 54 is shown to be in a state in which it is positioned at the developing position opposing the photoconductor 20.

To the rotating body 50, it is possible to attach: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of the developing units is the same, explanation will be made only about the yellow developing unit 54 below.

<Internal Configuration of Developing Unit>

The yellow developing unit 54 has the developing roller 510, a toner containing space 530, a housing 540 which serves as an example of a developer container, a toner supplying roller 550, a restriction blade 560, and a holder unit 610.

The developing roller 510 bears toner T and delivers it to the developing position opposing the photoconductor 20. The developing roller 510 is made of metal and, for example, it is manufactured from aluminum alloy such as aluminum alloy 5056 or aluminum alloy 6063, or iron alloy such as STKM, and the roller 510 is plated with, for example, nickel plating or chromium plating, as necessary.

Further, as shown in FIG. 3, the developing roller 510 is supported at both ends in its longitudinal direction and is rotatable about its central axis. As shown in FIG. 4, the developing roller 510 rotates in the opposite direction (counterclockwise in FIG. 4) to the rotating direction of the photoconductor 20 (clockwise in FIG. 4). The central axis of the roller 510 is located below the central axis of the photoconductor 20.

Further, as shown in FIG. 4, in a state where the yellow developing unit 54 opposes the photoconductor 20, there is a gap between the developing roller 510 and the photoconductor 20. That is, the yellow developing unit 54 develops the latent image formed on the photoconductor 20 in a non-contacting state. It should be noted that an alternating field is generated between the developing roller 510 and the photoconductor 20 upon development of the latent image formed on the photoconductor 20.

The holder unit 610 is structured of, for example, a holder 620 made of metal (such as aluminum alloy, SECC, and SPCC+Ni (nickel) plating) for supporting the developing roller 510, and an upper seal 520, which is an example of a sealing member, that is supported by the holder 620.

The upper seal 520 prevents the toner T in the yellow developing unit 54 from spilling out therefrom, and also collects the toner T, which is on the developing roller 510 that has passed the developing position, into the developing device without scraping it off. The upper seal 520 is a seal made of, for example, polyethylene film.

A seal-urging member 524 made of, for example, Moltoprene is provided on one side of the upper seal 520 opposite from the side of the developing roller 510. The upper seal 520 is pressed against the developing roller 510 by the elastic force of the seal-urging member 524.

Further, the abutting position at which the upper seal 520 abuts against the developing roller 510 is located above the central axis of the developing roller 510.

It should be noted that the holder unit 610 will be described in detail further below.

The housing 540 is manufactured by welding together a plurality of integrally-molded housing sections, that is, an upper housing section 542 and a lower housing section 544. The inside of the housing 540 is divided into two toner containing spaces 530, namely, the first toner containing space 530*a* and the second toner containing space 530*b*, by a partitioning wall 545 that is for partitioning the toner T and that protrudes inwards (in the up/down direction of FIG. 4) from the inner wall. It should be noted that an opening 572 is located at the lower section of the housing 540, and the developing roller 510 is arranged with respect to the opening 572 such that a portion of the roller 510 is exposed from the opening. The housing 540 is made of resin (such as ABS (acrylonitrile butadiene styrene) resin or PS (polystyrene) resin).

The toner containing spaces 530 may be provided with a stirring member for stirring the toner T. In the present embodiment, however, no stirring member is provided in the toner containing spaces 530 because each of the developing units (i.e., the black developing unit 51, the magenta developing unit 52, the cyan developing unit 53, and the yellow developing unit 54) is rotated with the rotation of the rotating body 50 and the toner T in each developing unit is thereby stirred.

The toner supplying roller 550 is provided in the first toner containing space 530*a* described above and supplies the toner T contained in the first toner containing space 530*a* to the developing roller 510. The toner supplying roller 550 is made of, for example, polyurethane foam, and is made to abut against the developing roller 510 in an elastically deformed state. The toner supplying roller 550 is arranged at a lower section of the toner containing space 530. The toner T contained in the toner containing spaces 530 is supplied to the developing roller 510 by the toner supplying roller 550 at the lower section of the toner containing space 530.

The toner supplying roller 550 is rotatable about its central axis. The central axis of the toner supplying roller 550 is situated below the central axis of rotation of the developing roller 510. Further, the toner supplying roller 550 rotates in the opposite direction (clockwise in FIG. 4) to the rotating direction of the developing roller 510 (counter-clockwise in FIG. 4). It should be noted that the toner supplying roller 550 has the function of supplying the toner T contained in the toner containing space 530 to the developing roller 510 as well as the function of stripping off, from the developing roller 510, the toner T remaining on the developing roller 510 after development.

The restriction blade 560 gives an electric charge to the toner T borne by the developing roller 510 as well as restricts the thickness of the layer of the toner T borne by the developing roller 510. The restriction blade 560 includes a rubber section 560*a* and a rubber-supporting section 560*b*.

The rubber section 560*a* is made of, for example, silicone rubber or urethane rubber. The rubber-supporting section 560*b* is a thin plate that is made of, for example, phosphor bronze or stainless steel, and that has a spring-like characteristic. The rubber section 560*a* is supported by the rubber-supporting section 560*b*, and the rubber-supporting section 560*b* is supported at one end by the holder 620.

Further, a blade-backing member 570 made of, for example, Moltoprene is provided on one side of the restriction blade 560 opposite from the side of the developing roller 510.

The rubber section 560*a* is pressed against the developing roller 510 by the elastic force caused by the flexure of the rubber-supporting section 560*b*. Further, the blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 more evenly.

The end of the restricting blade 560 opposite from the end that is being supported by the holder 620, i.e., the tip end of the restriction blade 560, is not placed in contact with the developing roller 510; rather, a section at a predetermined distance from the tip end contacts, with some breadth, the developing roller 510. That is, the restriction blade 560 does not abut against the developing roller 510 at its edge, but abuts against the roller 510 near its central portion. Further, the restriction blade 560 is arranged so that its tip end faces towards the upstream side of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550.

<Configuration of Driving Section>

Figure 17:
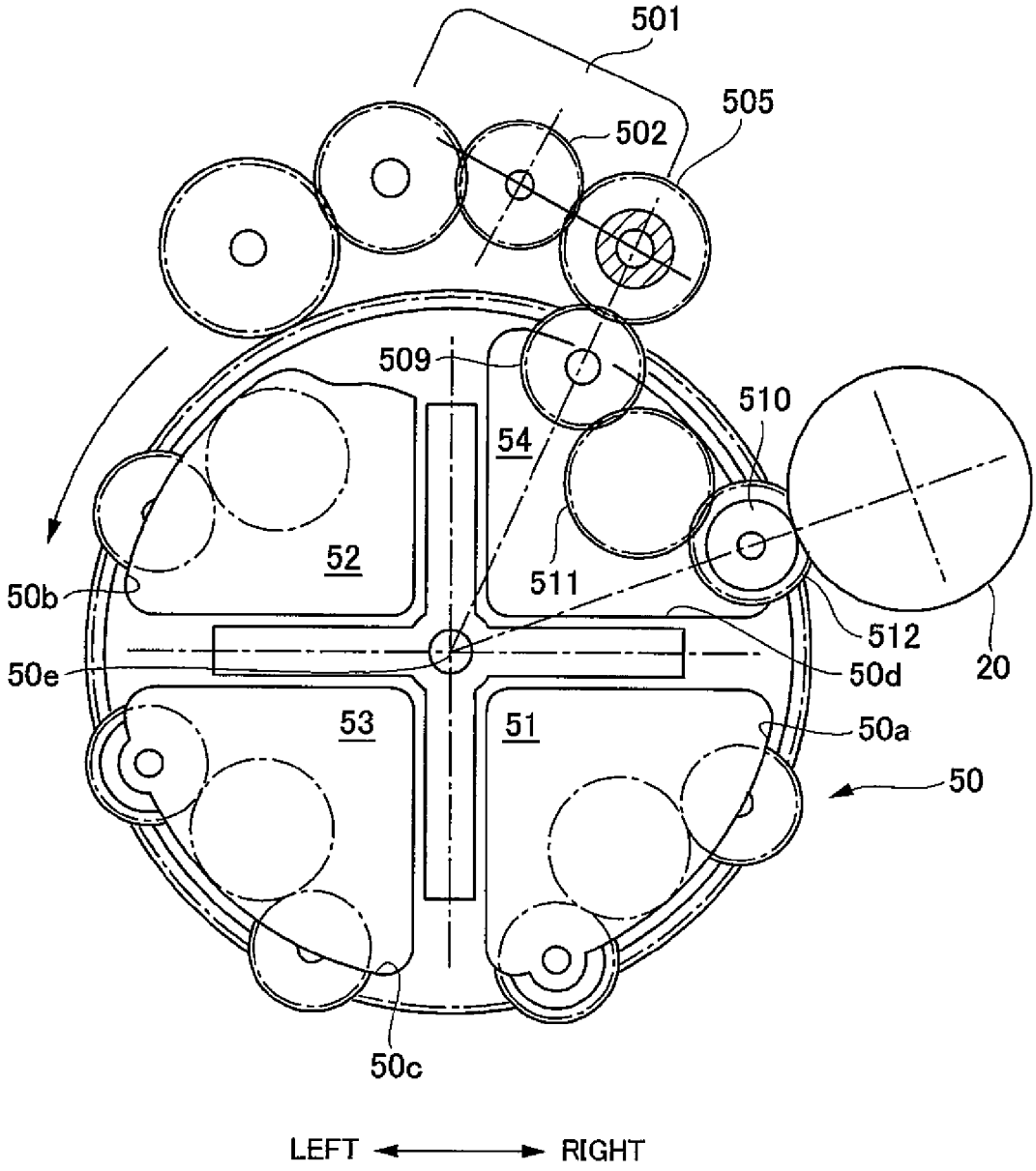
FIG. 17 is a diagram for describing the configuration of the driving section of the developing unit 54.

Next the configuration of the driving section of the yellow developing unit 54 is described with reference to FIG. 3 and FIG. 17. FIG. 17 is a diagram for describing the configuration of the driving section of the developing unit 54.

As shown in FIG. 3, the driving section of the developing unit 54 is provided with a developing-roller gear 512 which is for rotating the developing roller 510 and which is an example of a roller gear, a supplying-roller gear (not shown) for rotating the toner supplying roller 550, and an idler gear 511 which is an example of an intermediate gear.

The developing-roller gear 512 is provided on the side of one end of the developing roller 510, and rotates the developing roller 510 with the drive force transmitted from the drive motor 501, which is an example of a drive source. It should be noted that the developing-roller gear 512 meshes with the supplying-roller gear provided on the side of one end of the toner supplying roller 550.

The idler gear 511 is rotatably supported by the gear-supporting shaft 670, which is described further below, and transmits the drive force from the drive motor 501 to the developing-roller gear 512. It should be noted that the idler gear 511 meshes with the developing-roller gear 512.

Next, the way in which the drive force is transmitted from the drive motor 501 to the developing-roller gear 512 is described. As shown in FIG. 17, a drive gear 502 is attached to the motor shaft of the drive motor 501. The gear wheel train between the drive gear 502 and the developing-roller gear 512 include a development input gear 505 that meshes with the drive gear 502, a relay gear 509 that meshes with the development input gear 505, and the idler gear 511 that meshes with the relay gear 509.

In this way, the developing roller 510 rotates when the drive motor 501 is rotated.

<Operation of Developing Unit>

In the yellow developing unit 54 structured as above, the toner supplying roller 550 supplies the toner T contained in the toner containing spaces 530 to the developing roller 510.

With the rotation of the developing roller 510, the toner T, which has been supplied to the developing roller 510, reaches the abutting position of the restriction blade 560; then, as the toner T passes the abutting position, the toner is electrically charged and its layer thickness is restricted.

With further rotation of the developing roller 510, the toner T on the developing roller 510 whose layer thickness has been restricted reaches the developing position opposing the photoconductor 20; then, under the alternating field, the toner T is used at the developing position for developing the latent image formed on the photoconductor 20.

With further rotation of the developing roller 510, the toner T on the developing roller 510, which has passed the developing position, passes the upper seal 520 and is collected into the developing unit by the upper seal 520 without being scraped off.

Then, the toner T that still remains on the developing roller 510 can be stripped off by the toner supplying roller 550.

===(1) Overview of Holder Unit===

<Configuration of the Holder Unit 610>

Figure 5:
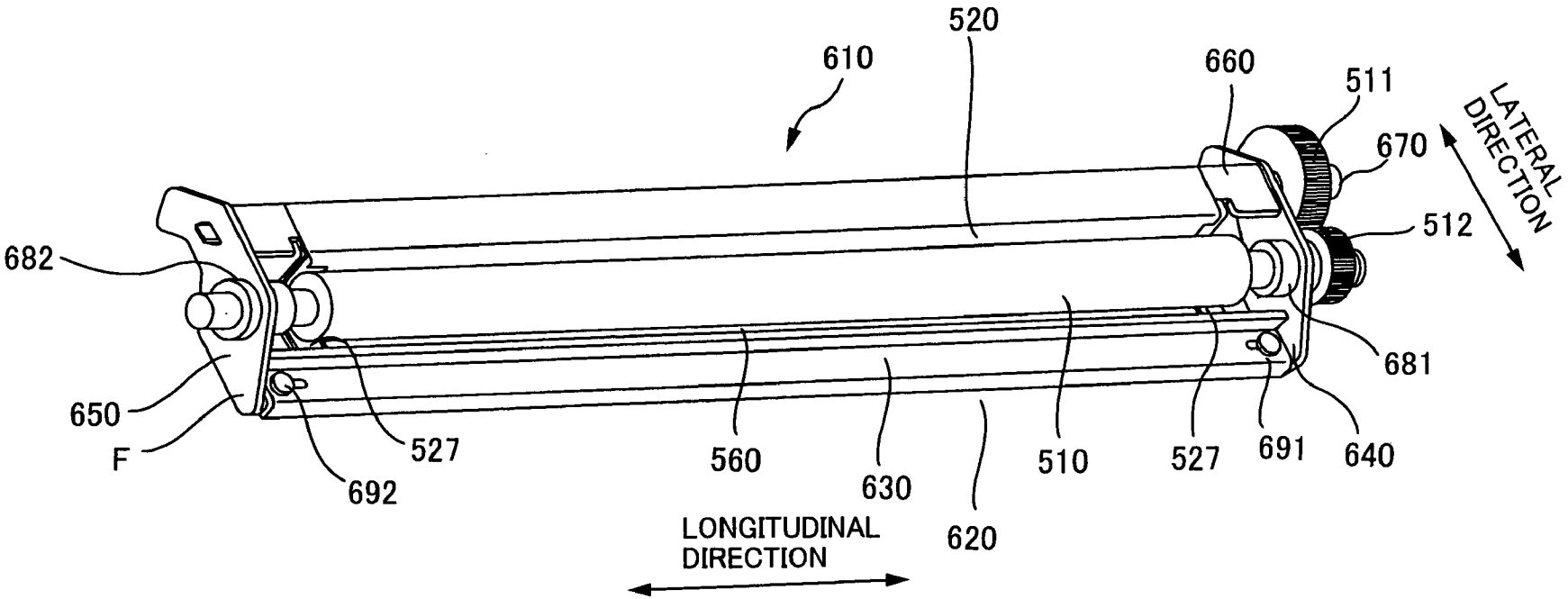
FIG. 5 is a diagram showing a holder 620 supporting a developing roller 510.
Figure 6:
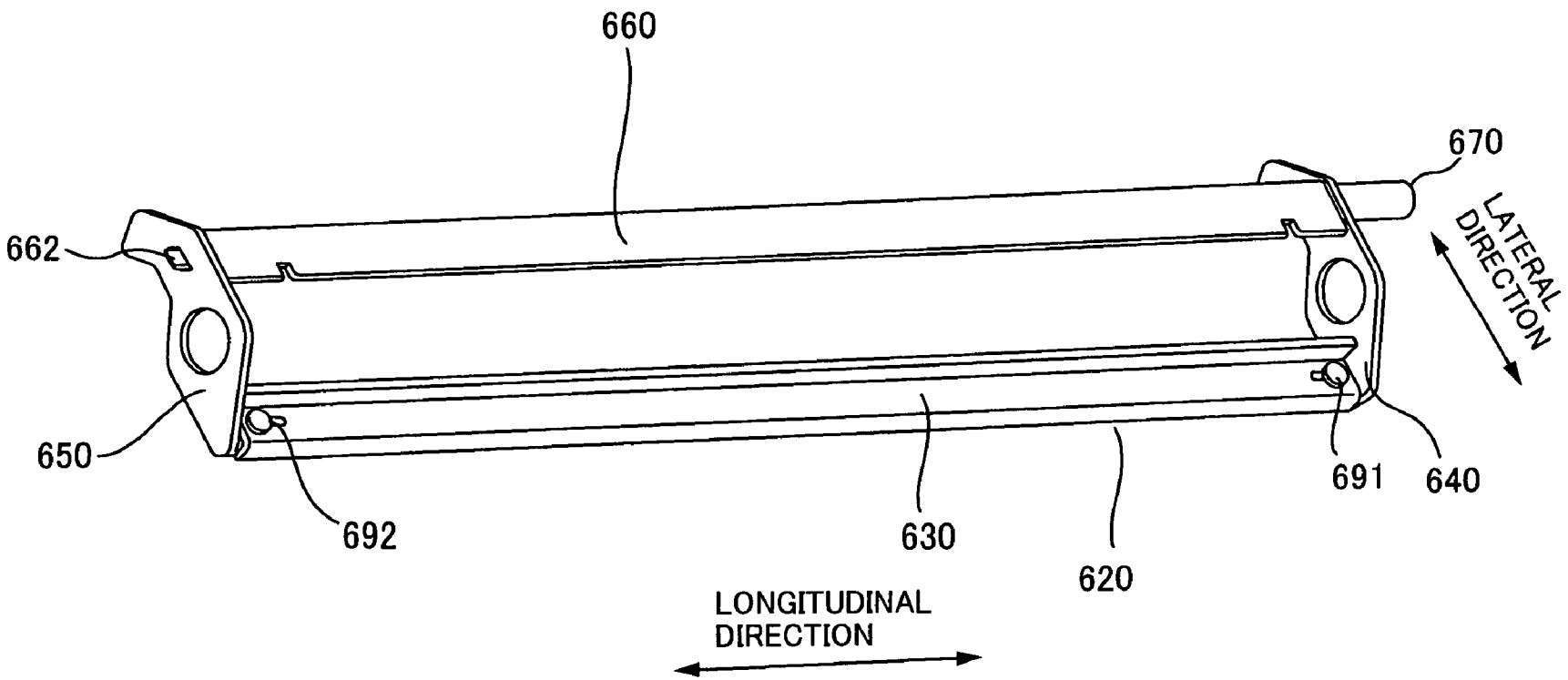
FIG. 6 is a diagram showing the holder 620 not supporting a developing roller 510.

Next, with reference to FIG. 3 to FIG. 6, the configuration of the holder unit 610 is described. FIG. 5 is a diagram showing the holder unit 610 supporting the developing roller 510. FIG. 6 is a diagram showing the holder 620.

The holder unit 610 includes the holder 620, which is an example of a roller-supporting member, that rotatably supports the developing roller 510, the upper seal 520, the restriction blade 560, and the end seals 527.

The holder 620 supports one end of the developing roller 510 via a bearing 681 and supports the other end of the developing roller 510 via a bearing 682. A gap S (see FIG. 3) exists between the holder 620 and the housing 540. It should be noted that the configuration of the holder 620 will be described in detail further below.

The upper seal 520 prevents the toner T from spilling from between the developing roller 510 and a portion of the housing 540 that forms the upper edge of the opening 572 (see FIG. 4).

The restriction blade 560 has the function of preventing the toner T from spilling from between the developing roller 510 a portion of the housing 540 that forms the lower edge of the opening 572 (see FIG. 4).

The end seals 527 are fixed to the rubber-supporting section 560b of the restriction blade 560 and prevent the toner T from spilling in the axial direction of the developing roller 510 at both ends thereof.

The holder unit 610 structured as above is mounted to the housing 540 such that its longitudinal direction is arranged in the longitudinal direction of the housing 540.

<Configuration of the Holder 620>

Figure 7:
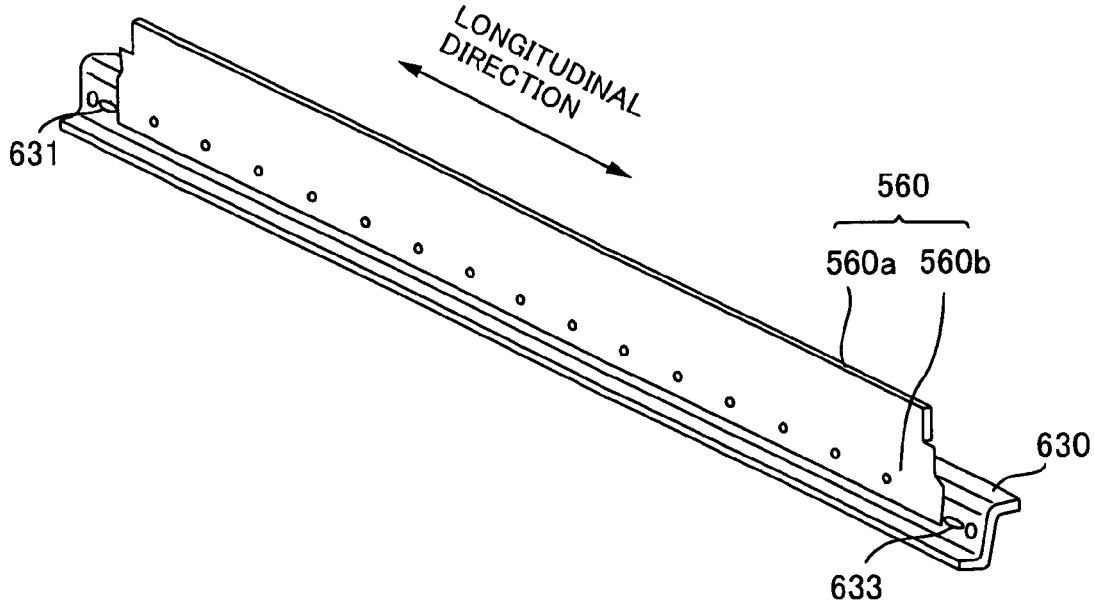
FIG. 7 is a diagram showing the lower frame 630.
Figure 8:
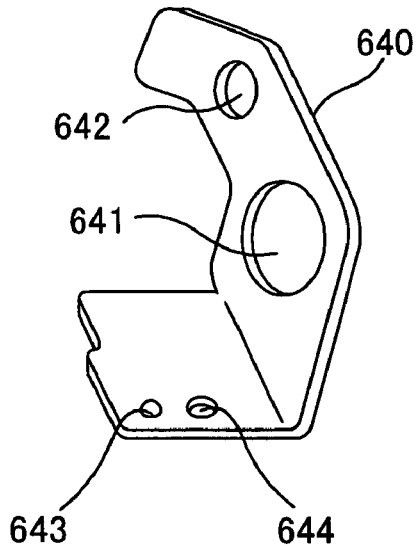
FIG. 8 is a diagram showing the front frame 640.
Figure 9:
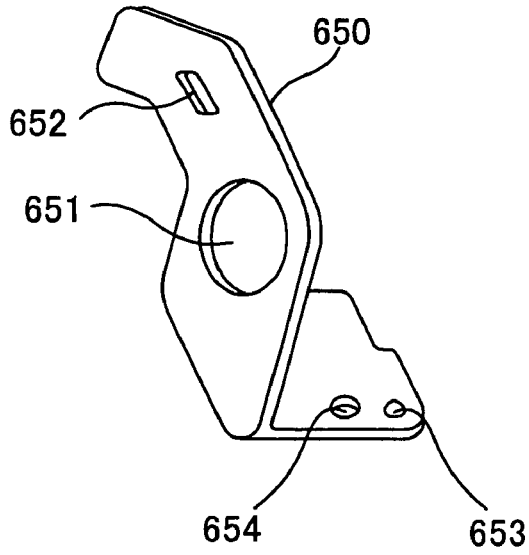
FIG. 9 is a diagram showing the rear frame 650.
Figure 10:
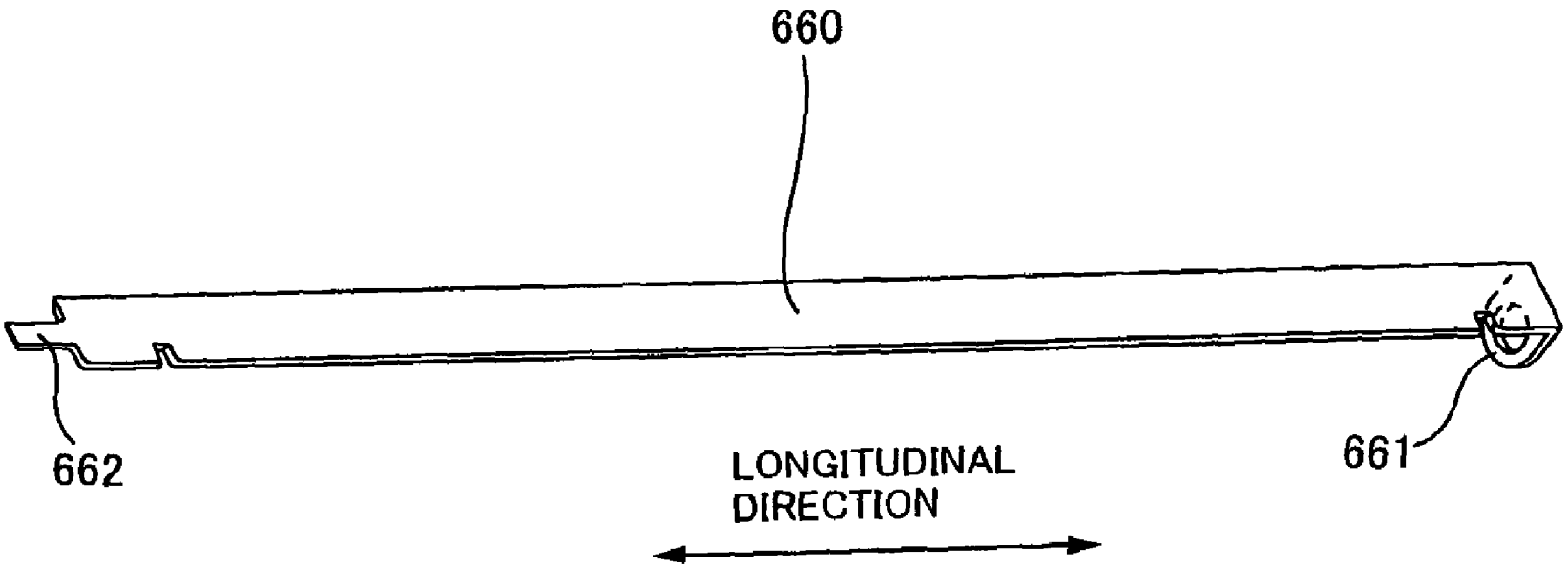
FIG. 10 is a diagram showing the upper frame 660.
Figure 11:
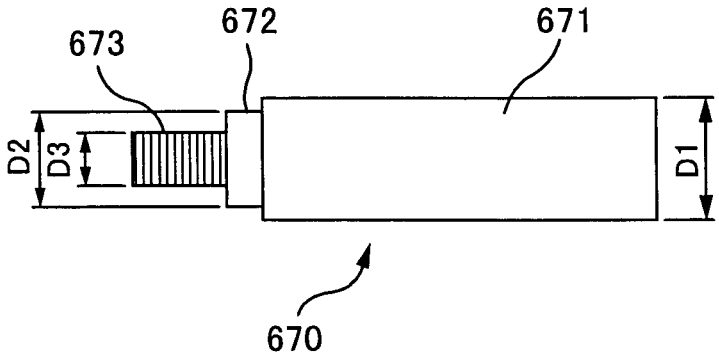
FIG. 11 is a diagram showing the gear-supporting shaft 670.
Figure 12:
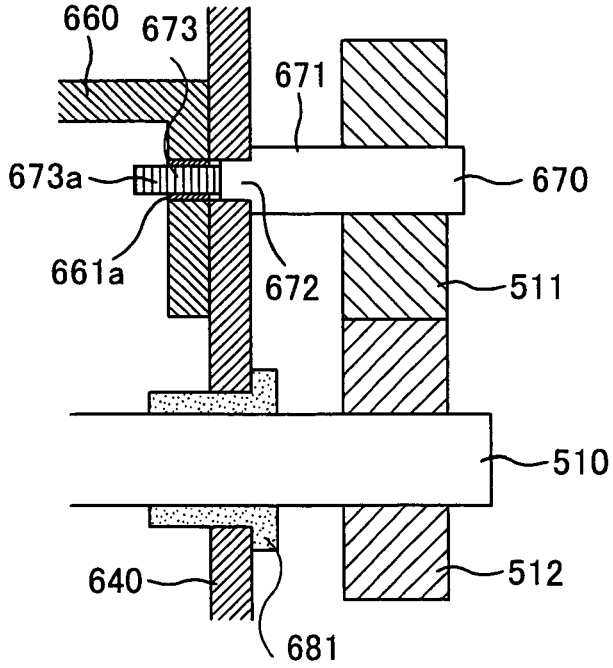
FIG. 12 is a diagram showing the configuration in the periphery of the gear-supporting shaft 670.

Next, with reference to FIG. 5 to FIG. 12, the configuration of the holder 620 will be described. FIG. 7 is a diagram showing the lower frame 630. FIG. 8 is a diagram showing the front frame 640. FIG. 9 is a diagram showing the rear frame 650. FIG. 10 is a diagram showing the upper frame 660. FIG. 11 is a diagram showing the gear-supporting shaft 670. FIG. 12 is a diagram showing the configuration in the periphery of the gear-supporting shaft 670 according to the present first embodiment.

As shown in FIG. 6, the holder 620 is made by connecting four members, i.e., a front frame 640 which is an example of a first supporting member and a one-end supporting member, a rear frame 650 which is an example of a second supporting member and an other-end supporting member, a upper frame 660 which is an example of a first longitudinal member and a longitudinal member, and a lower frame 630 which is an example of a second longitudinal member.

The front frame 640 rotatably supports one end of the developing roller 510 via the bearing 681. As shown in FIG. 8, the front frame 640 has a bearing hole 641, a supporting-shaft hole 642 which is an example of a shaft hole, a protrusion 643, and a screw hole 644.

The bearing hole 641 mates with the bearing 681. The supporting-shaft hole 642 mates with the gear-supporting shaft 670 that supports the idler gear 511. The protrusion 643 mates with a positioning hole 631 of the lower frame 630. The screw hole 644 in which a female screw is formed mates, via the lower frame 630, with a screw 691 on which a male screw is formed.

It should be noted that the front frame 640 is arranged in the lateral direction of the housing 540.

The rear frame 650 rotatably supports the other end of the developing roller 510 via the bearing 682. As shown in FIG. 9, the rear frame 650 has a bearing hole 651, a hole 652, a protrusion 653, and a screw hole 654.

The bearing hole 651 mates with the bearing 682. The hole 652 is for mating with a projection 662 of the upper frame 660. The protrusion 653 fits into a positioning hole 633 of the lower frame 630. The screw hole 654 in which a female screw is formed mates, via the lower frame 630, with a screw 692 on which a male screw is formed.

Further, the gap S (see FIG. 3) described above exists between a side surface F of the rear frame 650 that intersects with the longitudinal direction (see FIG. 5) and an opposition surface of the housing 540 that is in opposition to the side surface F. The gap S is provided for preventing the holder 620 and the housing 540 from interfering with one another when they expand or contract in the longitudinal direction due to a change in temperature.

It should be noted that the rear frame 650 is arranged in the lateral direction of the housing 540.

The upper frame 660 supports the upper seal 520. As shown in FIG. 10, the upper frame 660 has a screw hole 661 having a female screw 661*a* formed therein, and a projection 662.

By fitting a screw section 673 of the gear-supporting shaft 670 into the screw hole 661 through the front frame 640, the upper frame 660 and the front frame 640 are connected as shown in FIG. 12.

By fitting the projection 662 into the hole 652 of the rear frame 650, the upper frame 660 and the rear frame 650 are connected as shown in FIG. 6. Therefore, the upper frame 660 and the rear frame 650 are not connected with screws.

It should be noted that the upper frame 660 is arranged in the longitudinal direction of the housing 540.

The lower frame 630 supports the restriction blade 560. That is, the lower frame 630 also functions as a blade-supporting member for supporting the restriction blade 560. As shown in FIG. 7, the lower frame 630 has the positioning holes 631 and 633.

The positioning hole 631 mates with the protrusion 643 and the positioning hole 633 mates with the protrusion 653.

As shown in FIG. 6, the lower frame 630 and the front frame 640 are connected by means of a screw 691. Also, as shown in FIG. 6, the lower frame 630 and the rear frame 650 are connected by means of a screw 692.

It should be noted that the lower frame 630 is arranged in the longitudinal direction of the housing 540.

<Configuration of Gear-supporting Shaft 670>

Further, as shown in FIG. 11, the gear-supporting shaft 670 has a first shaft section 671, a second shaft section 672, and a screw section 673.

The first shaft section 671 rotatably supports the idler gear 511. The second shaft section 672 mates with the supporting-shaft hole 642 of the front frame 640. It should be noted that the diameter D2 of the second shaft section 672 is smaller than the diameter D1 of the first shaft section 671.

A male screw 673*a* is formed on the screw section 673. The male screw 673*a* mates, via the front frame 640, with a female screw 661*a* formed in the screw hole 661 as shown in FIG. 12. The winding direction of the thread of the male screw 673*a* is arranged in such a direction that the front frame 640 and the upper frame 660 become tightened together when the gear-supporting shaft 670 is turned in the rotating direction of the idler gear 511. It should be noted that the outer diameter D3 of the screw section 673 is smaller than the diameter D2 of the second shaft section 672.

<Procedure of assembling the holder 620>

Figure 13:
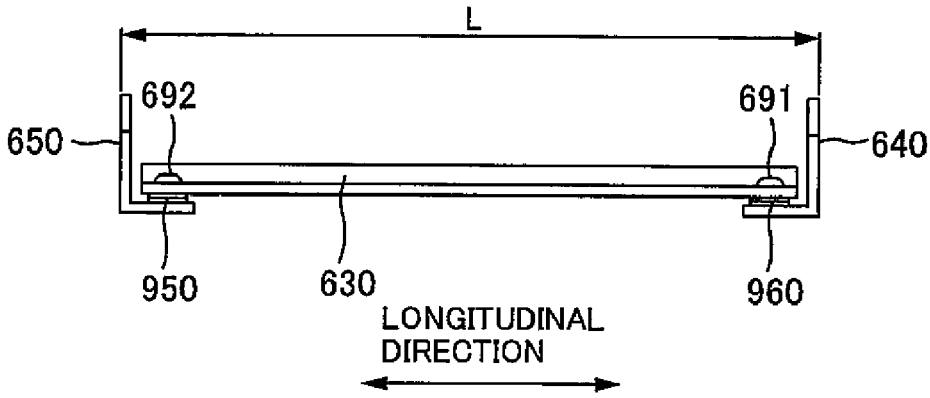
FIG. 13 is a schematic diagram for describing the procedure according to which the holder 620 is assembled.

Next, the procedure according to which the holder 620 is assembled is described with reference to FIG. 13. FIG. 13 is a schematic diagram for describing the procedure according to which the holder 620 is assembled.

First, the four members that structure the holder 620, that is, the lower frame 630, the front frame 640, the rear frame 650, and the upper frame 660, are prepared.

Then, the lower frame 630, the front frame 640, the rear frame 650, and the upper frame 660 are connected together while adjusting the state of connection between the lower frame 630, the front frame 640, the rear frame 650, and the upper frame 660 such that the holder 620 becomes a predetermined size. More specifically, the following procedures are carried out.

First, both the front frame 640 and the rear frame 650 are connected to the lower frame 630 while adjusting the state of connection of the front frame 640 and the rear frame 650 with respect to the lower frame 630.

For example, the attachment position, in the longitudinal direction, of the front frame 640 and the rear frame 650 with respect to the lower frame 630 is adjusted by adjusting the mating position, in the longitudinal direction, of the protrusion 643 of the front frame 640 (see FIG. 8) and the positioning hole 631 of the lower frame 630 (see FIG. 7), and the mating position, in the longitudinal direction, of the protrusion 653 of the rear frame 650 (see FIG. 9) and the positioning hole 633 of the lower frame 630 (see FIG. 7). In this way, it is possible to adjust the length of the holder 620 in the longitudinal direction to a predetermined length L.

Further, the height of the front frame 640 and the rear frame 650 with respect to the lower frame 630 is arranged by providing members 950 and 960 respectively between the rear frame 650 and the lower frame 630, and the front frame 640 and the lower frame 630. In this way, it is possible to precisely arrange the position of the developing roller 510 and the restriction blade 560.

Further, the lower frame 630 is connected to both the front frame 640 and the rear frame 650 by fitting, via the lower frame 630, the screw 691 into the screw hole 644 of the front frame 640 and by fitting, via the lower frame 630, the screw 692 into the screw hole 654 of the rear frame 650.

Next, the upper frame 660 is connected to both the front frame 640 and the rear frame 650 by fitting the projection 662 (see FIG. 10) into the hole 652 (see FIG. 9) and by fitting, via the front frame 640, the screw section 673 of the gear-supporting shaft 670 (see FIG. 11) into the screw hole 661 (see FIG. 10) of the upper frame 660 (see FIG. 12). It should be noted that the attachment position of the upper frame 660 with respect to the front frame 640 and the rear frame 650 may be adjusted in order to adjust the positional relationship between the upper seal 520 and the developing roller 510.

In this way, the length of the holder 620 in the longitudinal direction can be adjusted to a predetermined length L by connecting together the four members that structure the holder 620 (i.e., the lower frame 630, the front frame 640, the rear frame 650, and the upper frame 660) while adjusting the state of connection among the four members.

It should be noted that, when adjusting the state of connection among the four members, a device (also referred to as a "jig" below) that allows the positions of the members to be adjusted appropriately may be used. This makes it possible to adjust the state of connection more precisely and make the size of the holder 620 into the predetermined size.

===(1) Effect of Structuring a Holder by Connecting at Least Three Members===

As described above, the holder 620 (roller-supporting member) is structured by connecting at least three members (the lower frame 630, the front frame 640, the rear frame 650, and the upper frame 660). In this way, it is possible to provide more freedom (flexibility) in assembling the holder 620, and even when there are variations, due to individual differences, in the size of the members forming the holder 620, it becomes possible to assemble the holder 620 such that those variations in size of the members are absorbed. This is described in detail below.

Figure 14:
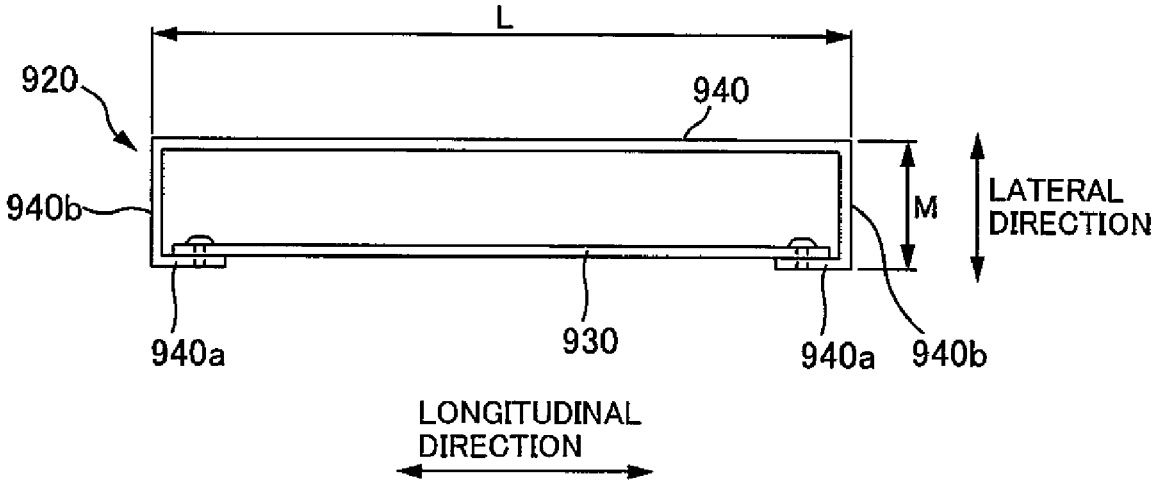
FIG. 14 is a schematic diagram for describing a holder 920 according to a comparative example.
Figure 15A:
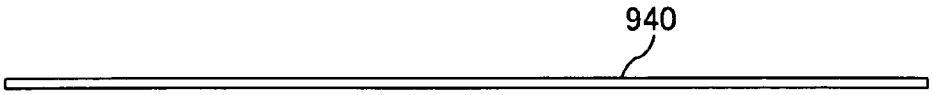
FIG. 15A is a diagram showing a second frame 940 before a first bent section 940*a* and a second bent section 940*b* are formed therein.
Figure 15B:
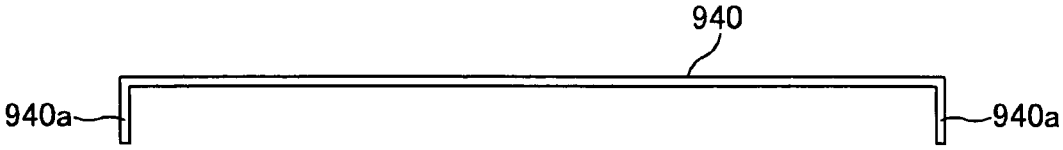
FIG. 15B is a diagram showing the second frame 940 having the first bent section 940*a* formed therein.
Figure 15C:
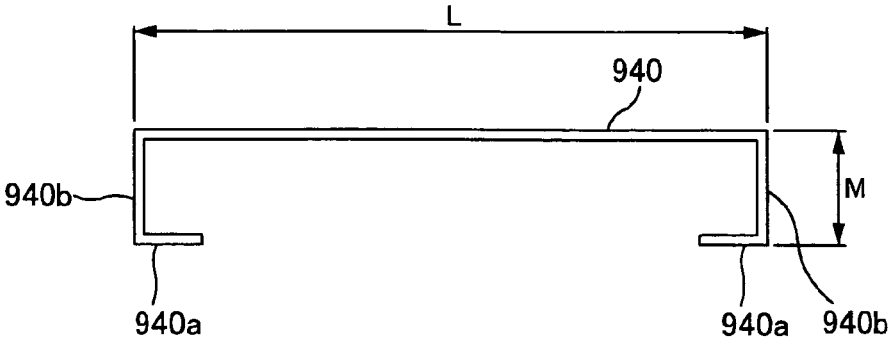
FIG. 15C is a diagram showing the second frame 940 having the first bent section 940*a* and the second bent section 940*b* formed therein.

First, a comparative example is described with reference to FIG. 14 and FIG. 15A to FIG. 15C. FIG. 14 is a schematic diagram for describing a holder 920 according to a comparative example. FIG. 15A is a diagram showing a second frame 940 before a first bent section 940*a* and a second bent section 940*b* are formed therein. FIG. 15B is a diagram showing the second frame 940 having the first bent section 940*a* formed therein. FIG. 15C is a diagram showing the second frame 940 having the first bent section 940*a* and the second bent section 940*b* formed therein.

The holder 920 is made of two members, i.e., a first frame 930 and the second frame 940. The first frame 930 and the second frame 940 are similar in shape.

The second frame 940 is similar in shape to a gathering of the front frame 640, the rear frame 650, and the upper frame 660, and has the first bent section 940*a* and the second bent section 940*b* formed therein. The second frame 940 is formed into a shape having the first bent section 940*a* and the second bent section 940*b* by bending a flat metal plate, such as that shown in FIG. 15A, twice as shown in FIG. 15B and FIG. 15C. Therefore, due to individual differences, it is difficult to make the length of the second frame 940 in the longitudinal direction and the lateral direction into a predetermined size (into length L and length M, respectively).

Incidentally, the coefficient of thermal expansion of the housing 540 (which is made, for example, of resin) and that of the holder 920 (which is made, for example, of metal) are different. Therefore, the amount of expansion/contraction due to a change in temperature is different between the housing 540 and the holder 920. Therefore, a gap (such as a gap S) is provided for preventing the holder 920 and the housing 540 from interfering with one another when they expand or contract due to a change in temperature. The gap is designed taking into consideration the amount of expansion/contraction due to a change in temperature of the holder 920 and the housing 540.

However, if the second frame 940 is formed larger than the predetermined size, then the housing 540 and the holder 920 may expand/contract due to a change in temperature and interfere with one another. This is because if the second frame 940 is larger than the predetermined size, then the amount of expansion/contraction of the holder 920 and the housing 540 when these expand/contract due to a change in temperature becomes larger than the gap.

As described above, if the holder 920 is structured by connecting only two members (i.e., the first frame 930 and the second frame 940), then the holder 920 cannot be formed into a desired size, and further the holder 920 and the housing 540 may interfere with one another when they expand or contract due to a change in temperature.

On the other hand, when the holder 620 is formed by connecting at least three members (the lower frame 630, the front frame 640, the rear frame 650, and the upper frame 660) as shown in FIG. 6, then the freedom (flexibility) in assembling the holder 620 is improved, and for example, the state of connection among the members can be adjusted. Therefore, it becomes possible to form the holder 620 into a desired size. Forming the holder 620 into a desired size allows the holder 620 and the housing 540 to be prevented from interfering with one another when they expand or contract due to a change in temperature.

===(1) Other Considerations===

The foregoing embodiment relates to a developing unit (developing device) 51, 52, 53, or 54 comprising: a housing 540 (developer containing section) that is for containing a toner T (developer) and that has a predetermined coefficient of thermal expansion; a developing roller 510 for bearing the toner T contained in the housing 540; a holder 620 (roller-supporting member) that is for rotatably supporting the developing roller 510 and that has a coefficient of thermal expansion which is different from the coefficient of thermal expansion of the housing 540; and a gap for preventing the holder 620 and the housing 540 from interfering with one another when they expand/contract due to a change in temperature.

It should be noted that in the foregoing embodiment, the upper frame 660 and the front frame 640 were connected by fitting the screw section 673 of the gear-supporting shaft 670 into the screw hole 661 through the front frame 640 (see FIG. 12). This, however, is not a limitation.

For example, the upper frame 660 and the front frame 640 can be connected by fitting a screw, other than the screw section 673 of the gear-supporting shaft 670, into a screw hole through the front frame 640.

Further, in the foregoing embodiment, the holder 620 was mounted to the housing 540 such that a longitudinal direction of the holder 620 is arranged in a longitudinal direction of the housing 540 (see FIG. 3); and the developing device had a gap S (see FIG. 3) for preventing the holder 620 and the housing 540 from interfering with one another when the holder 620 and the housing 540 expand/contract in their longitudinal direction due to a change in temperature. This, however, is not a limitation.

For example, the gap may be provided for preventing the holder 620 and the housing 540 from interfering with one another when they expand/contract in their lateral direction due to a change in temperature.

However, the length of the holder 620 and the housing 540 is longer in their longitudinal direction than in their lateral direction. Therefore, the amount of expansion/contraction due to a change in temperature becomes larger in the longitudinal direction than in the lateral direction. In view of this, developing devices are often provide with a gap for preventing the holder 620 and the housing 540 from interfering with one another when they expand/contract in their longitudinal direction due to a change in temperature. In this way, when the holder 620 is structured by connecting at least three members (the lower frame 630, the front frame 640, the rear frame 650, and the upper frame 660), it becomes possible to set the length of the holder 620 in the longitudinal direction to a desired size such that the housing 540 and the holder 620 do not interfere with one another even when they expand/contract in the longitudinal direction due to a change in temperature. The foregoing embodiment is therefore more preferable in this sense.

Further, in the foregoing embodiment, as shown in FIG. 6, the holder 620 was structured by connecting together the following four members: a front frame 640 (first supporting member) that is arranged in a lateral direction intersecting with the longitudinal direction of the holder 620 and that is for supporting one end of the developing roller 510, a rear frame 650 (second supporting member) that is arranged in the lateral direction and that is for supporting the other end of the developing roller 510, and a upper frame 660 (first longitudinal member) and a lower frame 630 (second longitudinal member) that are each connected to both the front frame 640 and the rear frame 650 and that are arranged in the longitudinal direction. This, however, is not a limitation.

Figure 16:
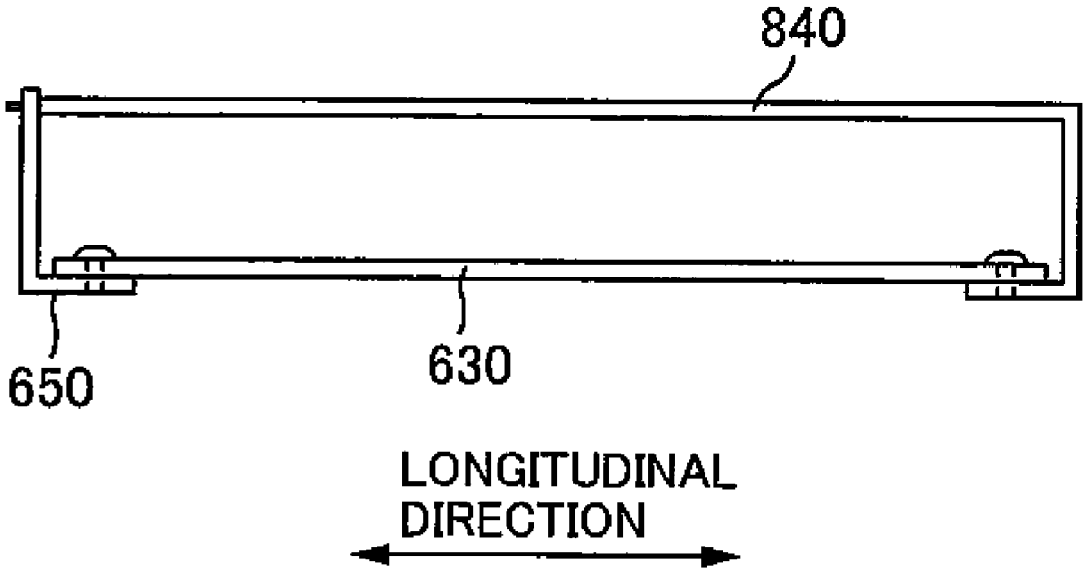
FIG. 16 is a schematic diagram showing another embodiment of the holder 620.

For example, the holder 620 may be made of three members, as shown in FIG. 16. That is, the holder 620 may be structured by connecting a lower frame 630, a rear frame 650, and a second front frame 840. It should be noted that FIG. 16 is a schematic diagram showing another embodiment of the holder 620.

However, when the holder 620 is structured by connecting four members (the lower frame 630, the front frame 640, the rear frame 650, and the upper frame 660), it is possible to increase the freedom (flexibility) in assembling the holder 620 and structure the holder 620 such that the length in the longitudinal direction of the holder 620 is set to a desired size, compared to a case where the holder is formed by connecting three members (the lower frame 630, the rear frame 650, and the second front frame 840). The foregoing embodiment is therefore more preferable in this sense.

Further, in the foregoing embodiment, the developing device had a restriction blade 560 for restricting a thickness of a layer of the toner T borne by the developing roller 510; and the lower frame 630 was a blade-supporting member (see FIG. 7) for supporting the restriction blade 560. This, however, is not a limitation.

For example, the lower frame 630 does not have to support the restriction blade 560.

However, it is necessary to control the position between the developing roller 510 and the restriction blade 560 with satisfactory precision in order to restrict the thickness of the layer of the toner T borne on the developing roller 510. If the holder 620 is made of four members (the lower frame 630, the front frame 640, the rear frame 650, and the upper frame 660), then it becomes possible to structure the holder 620 such that the positioning between the developing roller 510 and the restriction blade 560 is performed with high precision. The foregoing embodiment is therefore more preferable in this sense.

Further, in the foregoing embodiment, a developing-roller gear 512 (roller gear) for rotating the developing roller 510 with a drive force transmitted from a motor 501 (drive source) was provided on the one end of the developing roller 510; and the gap S (see FIG. 3) existed between a side surface F of the rear frame 650 that intersects with the longitudinal direction, and an opposition surface of the housing 540 that is in opposition to the side surface F. This, however, is not a limitation.

For example, the gap may be between a side surface of the front frame 640 that intersects with the longitudinal direction and an opposition surface of the housing 540 that is in opposition to that side surface.

However, it is possible to prevent the driving section from being affected by providing the gap S, which is between the holder 620 and the housing 540, between the side surface F of the rear frame 650 and the opposition surface of the housing 540, that is, on the opposite side from the driving section where the developing-roller gear 512 is located. The foregoing embodiment is therefore more preferable in this sense.

Further, in the foregoing embodiment, the lower frame 630 and the front frame 640 were connected with a screw, the lower frame 630 and the rear frame 650 were connected with a screw, and the front frame 640 and the upper frame 660 were connected with a screw (see FIG. 5 and FIG. 12); and the rear frame 650 and upper frame 660 were not connected with a screw. This, however, is not a limitation.

For example, the rear frame 650 and the upper frame 660 may also be connected with screws.

However, since the lower frame 630 and the front frame 640, the lower frame 630 and the rear frame 650, and the front frame 640 and the upper frame 660 are connected with screws, respectively, even when the rear frame 650 and upper frame 660 are not connected with a screw, the function of the holder 620, which is to support the developing roller 510, can be achieved. Further, by not connecting the rear frame 650 and upper frame 660 with a screw, the time required for assembling the holder 620 can be shortened. The foregoing embodiment is therefore more preferable in this sense.

Further, in the foregoing embodiment, a projection 662 was provided at an end of the upper frame 660 that is connected to the rear frame 650; a hole 652 was provided in the rear frame 650; and the projection 662 was fitted into the hole 652 (see FIG. 6). This, however, is not a limitation.

For example, the upper frame 660 does not have to be provided with the projection 662 and the rear frame 650 does not have to be provided with the hole 652.

However, when the upper frame 660 is provided with the projection 662 and the rear frame 650 is provided with the hole 652, it becomes possible to set the length in the longitudinal direction of the holder 620 to a desired size, even when there are variations in size in the longitudinal direction of the upper frame 660 due to individual differences. The foregoing embodiment is therefore more preferable in this sense.

Further, in the foregoing embodiment, the housing 540 was made of resin (such as ABS (acrylonitrile butadiene styrene) resin or PS (polystyrene) resin), and the holder 620 was made of metal (such as aluminum alloy, SECC, and SPCC+Ni (nickel) plating). This, however, is not a limitation.

For example, the housing 540 and the holder 620 may both be made of resin.

However, the housing 540 is often made of resin to achieve weight reduction, and the holder 620 is often made of metal to hold the developing roller 510 reliably. The difference in the coefficient of thermal expansion between resin and metal is larger than the difference in the coefficient of thermal expansion between two resin components. Therefore, the resin-made housing 540 and the metal-made holder 620 are more likely to interfere with one another when they expand/contract due to a change in temperature. Thus, the effect of the present embodiment, i.e., the effect of allowing the holder 620 to be structured in a desired size, is achieved more advantageously. The foregoing embodiment is therefore more preferable in this sense.

<<<Second Embodiment>>>

Next, a developing unit according to a second embodiment will be described, focusing on only the features that are different from those of the first embodiment. It should be noted that the configuration of the overall image forming apparatus and the configuration of the control unit are the same for the present second embodiment, the first embodiment described above, and third embodiment described later on. Further, the descriptions on the "Overview of developing unit", "Internal configuration of developing unit", "Configuration of driving section", "Operation of developing unit", "Overview of holder unit", "Configuration of the holder unit 610", "Configuration of the holder 620", and "Configuration of gear-supporting shaft 670" that were given in the first embodiment apply to the second embodiment as well, and therefore, repeated description thereof is omitted.

It should be noted that the holder unit 610 of the present second embodiment includes the holder 620, which is an example of a roller-supporting member, that rotatably supports the developing roller 510, the upper seal 520, the restriction blade 560, and the end seals 527, and in addition to these, a gear-supporting shaft 670 that is fixed to the holder 620.

<Periphery of Gear-supporting Shaft 670>

As described above, the second shaft section 672 of the gear-supporting shaft 670 is fitted to the supporting-shaft hole 642 of the front frame 640. Further, the outer diameter D2 of the second shaft section 672 is approximately equal to the inner diameter of the supporting-shaft hole 642. Therefore, when the second shaft section 672 is fitted into the supporting-shaft hole 642, the gear-supporting shaft 670 is supported at a predetermined position with respect to the front frame 640.

Further, the developing roller 510 is supported by the front frame 640 through the bearing 681. The outer diameter of the developing roller 510 is approximately equal to the inner diameter d1 of the bearing 681, and the outer diameter d2 of the bearing 681 is approximately equal to the inner diameter of the bearing hole 641. Therefore, the developing roller 510 is supported at a predetermined position with respect to the front frame 640.

Figure 18:
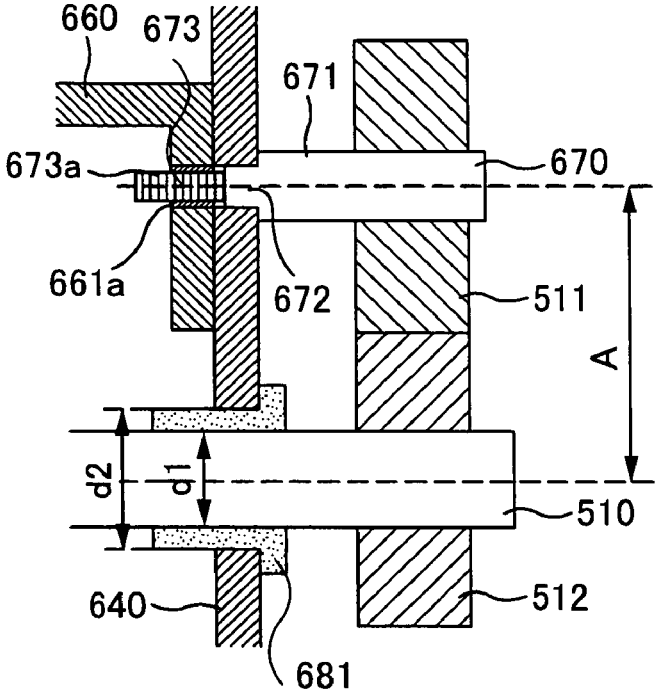
FIG. 18 is a diagram showing the configuration in the periphery of the gear-supporting shaft 670 according to a second embodiment.

Since the developing roller and the gear-supporting shaft 670 are supported at a predetermined position with respect to the front frame 640 as described above, it is possible to set the distance between the developing-roller gear 512 supported by the developing roller 510 and the idler gear 511 supported by the gear-supporting shaft 670 to a predetermined distance A (see FIG. 18).

It should be noted that since the gear-supporting shaft 670 is supported at a predetermined position with respect to the front frame 640 as described above, the upper frame 660 can be connected to the front frame 640 at a predetermined position when the screw section 673 is fitted into the screw hole 661.

===(2) Function of Gear-supporting Shaft 670===

As described above, the holder 620 (the roller-supporting member) is structured by connecting at least two members (the front frame 640, the rear frame 650, the upper frame 660, and the lower frame 630), and the two members (the front frame 640 and the upper frame 660) that structure the holder 620 are connected with the screw section 673 provided on the gear-supporting shaft 670. In this way, the gear-supporting shaft 670 functions also as a screw, and thus, the ease of assembly of the holder 620 can be improved. This is described in detail below.

Since the developing roller 510 is supported at both ends (i.e., at one end and the other end), the holder 620 is structured by connecting at least two members (the front frame 640, the rear frame 650, the upper frame 660, and the lower frame 630).

Further, the gear-supporting shaft 670 that supports the idler gear 511 for transmitting the drive force from the drive motor 501 to the developing-roller gear 512 is fixed to the holder 620.

For this reason, there has been a need to carry out two different tasks (i.e., the task of connecting the two members with a screw and the task of fixing the gear-supporting shaft 670 to the member) when assembling the holder 620.

On the other hand, by providing a screw section 673 on the gear-supporting shaft 670 as in the present embodiment, the two members (the front frame 640 and the upper frame 660) are connected at the same time the gear-supporting shaft 670 is fixed to the holder 620. In other words, connection of the front frame 640 and the upper frame 660 and fixing of the gear-supporting shaft 670 to the holder 620 are carried out through a single task. Therefore, it is possible to shorten the time necessary for assembling the holder 620.

As described above, by connecting the front frame 640 and the upper frame 660 using the screw section 673 of the gear-supporting shaft 670, it is possible to shorten the amount of time necessary for assembling the holder 620, and thus improve the ease of assembly of the holder 620.

===(2) Other Considerations===

The foregoing embodiment relates to a developing unit (developing device) 51, 52, 53, or 54 comprising: a developing roller 510 for bearing a toner T (developer); a holder 620 (roller-supporting member) for rotatably supporting the developing roller 510; a developing-roller gear 512 (roller gear) that is provided at one end of the developing roller 510 and that is for rotating the developing roller 510; an idler gear 511 (intermediate gear) for transmitting a drive force from a drive motor 501 (drive source) to the developing-roller gear 512; and a gear-supporting shaft 670 for rotatably supporting the idler gear 511.

It should be noted that in the foregoing embodiment, the upper frame 660 and the rear frame 650 were connected by fitting the projection 662 of the upper frame 660 into the hole 652 of the rear frame 650 (see FIG. 6). This, however, is not a limitation.

For example, the upper frame 660 and the rear frame 650 may be connected with screws. However, connecting the upper frame 660 and the rear frame 650 by fitting the projection 662 into the hole 652 renders the screws for connecting the upper frame 660 and the rear frame 650 unnecessary, and thus, the ease in assembly of the holder 620 can be further improved.

Further, in the foregoing embodiment, the front frame 640 and the lower frame 630 were connected with a screw 691. This, however, is not a limitation.

For example, the front frame 640 and the lower frame 630 may be connected using a screw section provided on a gear-supporting shaft that supports another gear. In this case, since the screw 691 becomes unnecessary, the ease in assembly of the holder 620 can be further improved.

Further, in the foregoing embodiment, one of the at least two members (the front frame 640 and the upper frame 660) forming the holder 620 was a front frame 640 (one-end supporting member) for rotatably supporting, through a bearing 681, the one end of the developing roller 510; and as shown in FIG. 8, the front frame 640 was provided with a supporting-shaft hole 642 (shaft hole) for mating with the gear-supporting shaft 670 and a bearing hole 641 for mating with the bearing 681. This, however, is not a limitation.

For example, the gear-supporting shaft 670 does not have to fit into the supporting-shaft hole 642. Further, the bearing 681 does not have to fit into the bearing hole 641.

However, when the gear-supporting shaft 670 is fitted into the supporting-shaft hole 642 and the bearing 681 is fitted into the bearing hole 641 as described above, the positions where the gear-supporting shaft 670 and the bearing 681 are mated with the front frame 640 can be kept constant. In this way, the distance between the idler gear 511 supported by the gear-supporting shaft 670 and the developing-roller gear 512 supported by the developing roller 510 that mates with the bearing 681 can be set to a constant value. Therefore, it becomes possible to control the distance between the idler gear 511 and the developing-roller gear 512 with high precision. The foregoing embodiment is therefore more preferable in this sense.

Further, in the foregoing embodiment, the idler gear 511 meshed with the developing-roller gear 512. This, however, is not a limitation.

For example, another gear may be provided between the idler gear 511 and the developing-roller gear 512.

However, when the idler gear 511 meshes with the developing-roller gear 512 (see FIG. 18), it is possible to transmit the drive force from the idler gear 511 to the developing-roller gear 512 properly when the distance between the idler gear 511 and the developing-roller gear 512 is controlled with higher precision. The foregoing embodiment is therefore more preferable in this sense.

Further, in the foregoing embodiment, the two members were: the front frame 640, and an upper frame 660 (longitudinal member) that is arranged in a longitudinal direction of the developing roller 510 and that is connected to the front frame 640; the gear-supportingshaft 670 was provided with: a first shaft section 671 for rotatably supporting the idler gear 511, a second shaft section 672 whose diameter is smaller than a diameter of the first shaft section 671, and the screw section 673 whose diameter is smaller than the diameter of the second shaft section 672 and on which a male screw 673*a* is formed; the upper frame 660 had a screw hole 661 having a female screw 661*a* formed therein; and the front frame 640 and the upper frame 660 were connected by fitting the male screw 673*a* into the female screw 661*a* in a state where the second shaft section 672 is fitted into the supporting-shaft hole 642 (see FIG. 18). This, however, is not a limitation.

Figure 19:
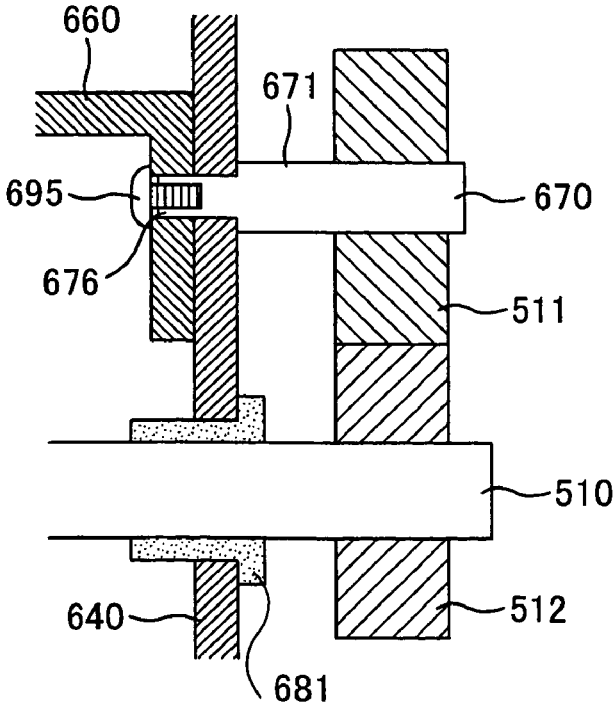
FIG. 19 is a diagram for describing another example of the second embodiment.

For example, as shown in FIG. 19, the gear-supporting section 670 may be provided with the first shaft section 671 and a screw section 676 having a female screw formed therein; the upper frame 660 may have a hole 668 that does not have a female screw; and the front frame 640 and the upper frame 660 may be connected by fitting the male screw formed on a screw 695 into the female screw formed in the screw section 676 in a state where the screw section 676 is fitted into the supporting-shaft hole 642 and the hole 668. It should be noted that FIG. 19 is a diagram for describing another example.

However, by connecting the front frame 640 and the upper frame 660 by fitting the male screw 673*a* into the female screw 661*a* in a state where the second shaft section 672 is fitted into the supporting-shaft hole 642, it becomes possible to reliably connect the front frame 640 and the upper frame 660 with a simple structure.

Further, in the foregoing embodiment, the idler gear 511 rotated in a predetermined direction (the direction shown in FIG. 4); and a winding direction of a thread of the male screw 673*a* was arranged in such a direction that the front frame 640 and the upper frame 660 are tightened together when the gear-supporting shaft 670 is rotated in the rotating direction of the idler gear 511. This, however, is not a limitation.

For example, the winding direction of the thread of the male screw 673*a* may be arranged in such a direction that the front frame 640 and the upper frame 660 are loosened when the gear-supporting shaft 670 is rotated in the rotating direction of the idler gear 511.

However, when the winding direction of the thread of the male screw 673*a* is arranged in such a direction that the front frame 640 and the upper frame 660 are tightened together, it becomes possible to prevent the male screw 673*a* from loosening from the female screw 661*a*. The foregoing embodiment is therefore more preferable in this sense.

Further, in the foregoing embodiment, the developing device had: a housing 540 (developer containing section) for containing a toner T, and a upper seal 520 that abuts against the developing roller 510 and that is for preventing the toner T from spilling from between the developing roller 510 and the housing 540; and the upper seal 520 was supported by the upper frame 660. This, however, is not a limitation.

For example, the upper seal 520 may be supported by the housing 540.

However, by fitting the male screw 673*a* of the gear-supporting shaft 670, which is supported at a predetermined position with respect to the front frame 640 through mating of the second shaft section 672 and the supporting-shaft hole 642, into the female screw 661*a* of the upper frame 660, it is possible to control the attachment position of the upper frame 660 with respect to the front frame 640 with satisfactory precision. In this case, it is possible to properly control the abutment of the upper seal 520 against the developing roller 510 when the upper seal 520 is supported by the upper frame 660, and therefore effectively prevent the toner T from spilling from between the developing roller 510 and the housing 540. The foregoing embodiment is therefore more preferable in this sense.

Further, in the foregoing embodiment, the holder 620 was structured by connecting together the following four members: the front frame 640, a rear frame 650 (other-end supporting member) for rotatably supporting, through a bearing 682, an other end of the developing roller 510, and the upper frame 660 and a lower frame 630 (second longitudinal member) that are each connected to both the front frame 640 and the rear frame 650 and that are arranged in the longitudinal direction. This, however, is not a limitation.

For example, the holder 620 may be structured by connecting two or three members.

<<<Third Embodiment>>>

===(3) Overview of Developing Unit===

Figure 20:
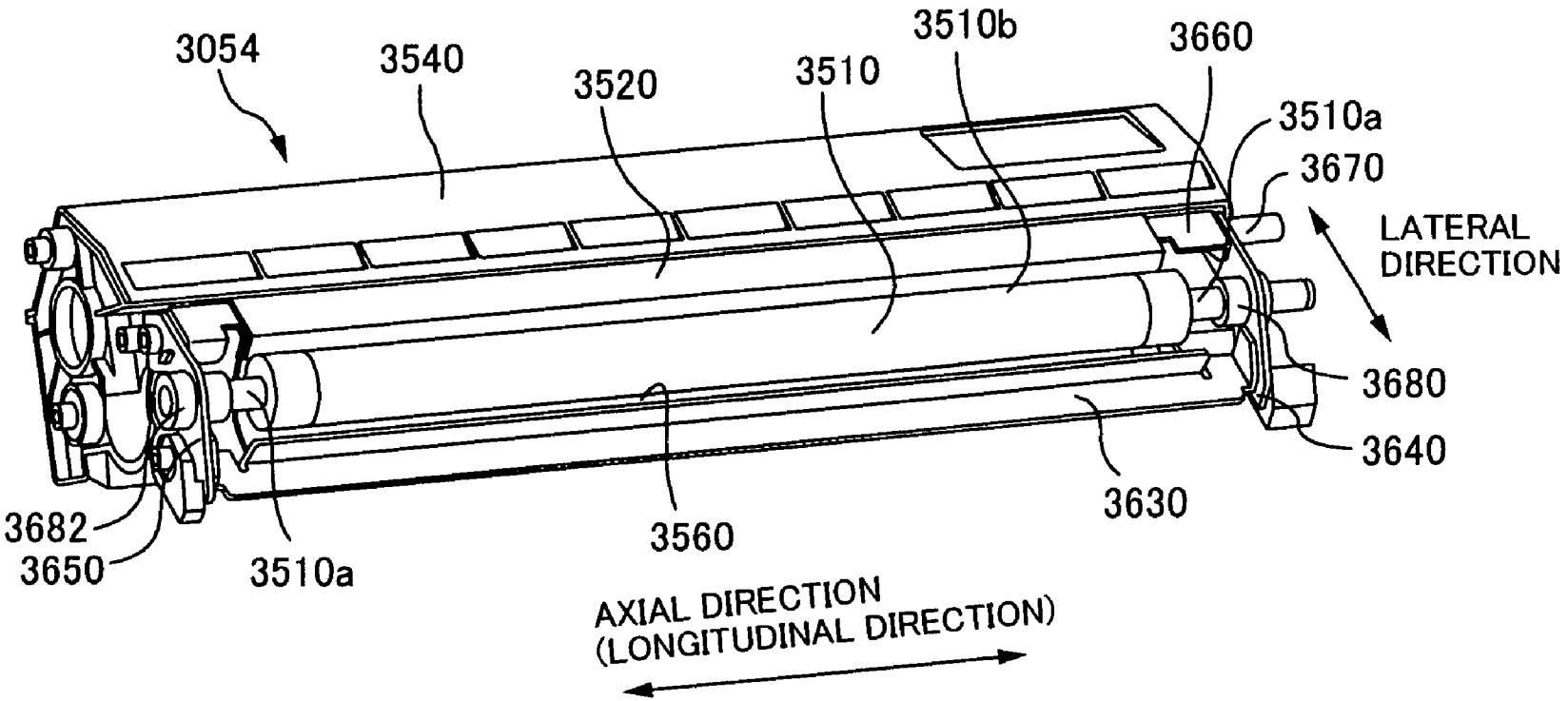
FIG. 20 is a perspective view of a developing unit 3054 according to a third embodiment.
Figure 21:
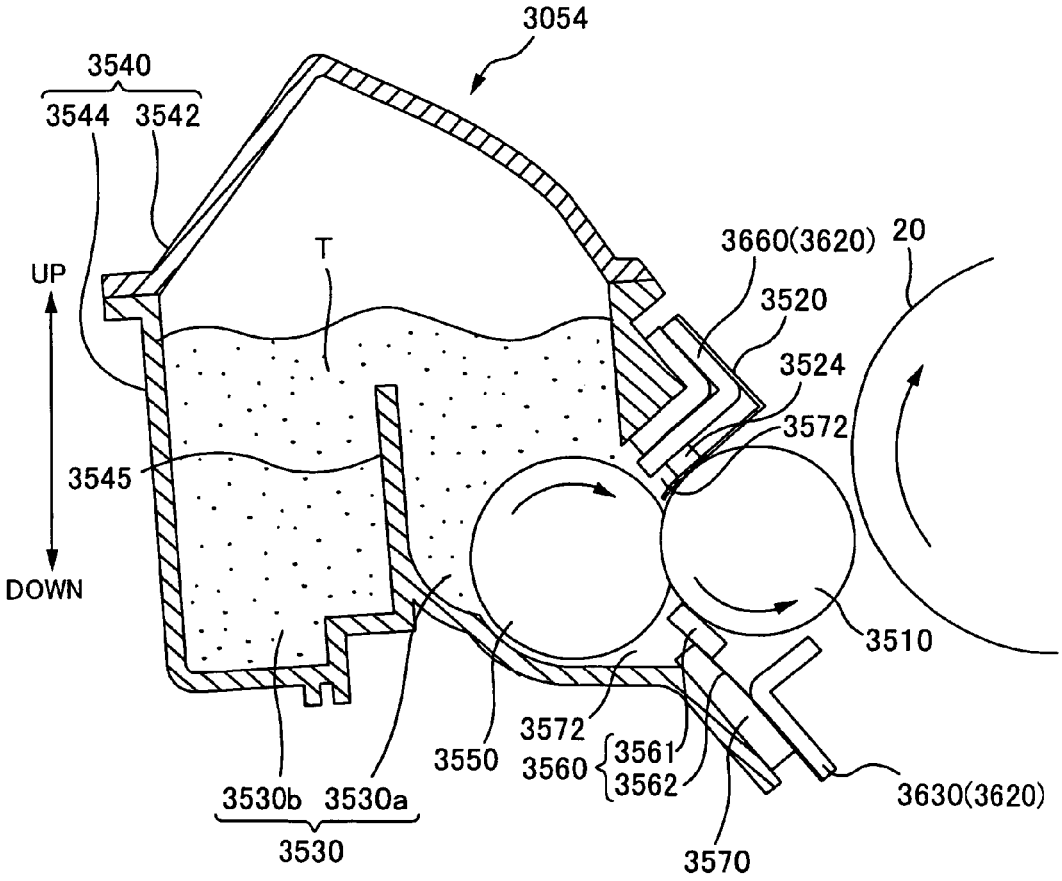
FIG. 21 is a section view showing main structural components of the developing unit 3054 according to the third embodiment.

Next, using FIG. 20 and FIG. 21, an example of a configuration of a developing unit according to a third embodiment will be described. It should be noted that the configuration of the overall image forming apparatus and the configuration of the control unit are the same for the present third embodiment and the first and second embodiments described above. FIG. 20 is a conceptual diagram of a developing unit according to a third embodiment. FIG. 21 is a section view showing main structural components of the developing unit 3054 according to the third embodiment. It should be noted that the section view shown in FIG. 21 is a cross section of the developing unit 3054 bisected by a plane perpendicular to the longitudinal direction shown in FIG. 20. Further, in FIG. 21, the arrow indicates the vertical direction as in FIG. 1, and, for example, the central axis of the developing roller 3510 is located below the central axis of the photoconductor 20. Further, in FIG. 21, the yellow developing unit 3054 is shown to be in a state in which it is positioned at the developing position opposing the photoconductor 20.

To the rotating body 50, it is possible to attach: the black developing unit 51 containing black (K) toner; the magenta developing unit 52 containing magenta (M) toner; the cyan developing unit 53 containing cyan (C) toner; and the yellow developing unit 3054 (54) containing yellow (Y) toner. Since the configuration of the developing units of this embodiment is the same, explanation will be made only about the yellow developing unit 3054 below.

<Configuration of Developing Unit>

The yellow developing unit 3054 has the developing roller 3510 which is an example of a developer bearing roller, an upper seal 3520 which is an example of a sealing member, a housing 3540, a toner supplying roller 3550, a restriction blade 3560 which is an example of a developer charging member, and so forth.

The developing roller 3510 bears toner T and delivers it to the developing position opposing the photoconductor 20. The developing roller 3510 is made of metal and, for example, it is manufactured from aluminum alloy such as aluminum alloy 5056 or aluminum alloy 6063, or iron alloy such as STKM, and the roller 3510 is plated with, for example, nickel plating or chromium plating, as necessary.

The developing roller 3510 has a shaft section 3510*a* and a large-diameter section 3510*b*. The shaft section 3510*a* is supported, through bearings 3680 and 3682, by a first side metal plate 3640 and a second side metal plate 3650 of a holder 3620 described further below, and thereby the developing roller 3510 is supported rotatably. As shown in FIG. 21, the developing roller 3510 rotates in the opposite direction (counterclockwise in FIG. 21) to the rotating direction of the photoconductor 20 (clockwise in FIG. 21). The central axis of the roller 3510 is located below the central axis of the photoconductor 20.

Further, as shown in FIG. 21, in the state where the yellow developing unit 3054 opposes the photoconductor 20, there is a gap between the developing roller 3510 and the photoconductor 20. That is, the yellow developing unit 3054 develops the latent image formed on the photoconductor 20 in a non-contacting state. It should be noted that an alternating field is generated between the developing roller 3510 and the photoconductor 20 upon development of the latent image formed on the photoconductor 20.

The housing 3540 is manufactured by welding together a plurality of integrally-molded housing sections, that is, an upper housing section 3542 and a lower housing section 3544. In the housing 3540 is formed a toner containing section 3530 for containing the toner T. The toner containing section 3530 is divided into two toner containing sections, namely, the first toner containing section 3530*a* and the second toner containing section 3530*b*, by a partitioning wall 3545 that is for partitioning the toner T and that protrudes inwards (in the up/down direction of FIG. 21) from the inner wall. It should be noted that an opening 3572 is located at the lower section of the housing 3540, and the developing roller 3510 is arranged with respect to the opening 3572 such that a portion of the roller 3510 is exposed from the opening.

The toner containing sections 3530 may be provided with a stirring member for stirring the toner T. In the present embodiment, however, no stirring member is provided in the toner containing sections 3530 because each of the developing units (i.e., the black developing unit 51, the magenta developing unit 52, the cyan developing unit 53, and the yellow developing unit 3054 (54)) is rotated with the rotation of the rotating body 50 and the toner T in each developing unit is thereby stirred.

The toner supplying roller 3550 is provided in the first toner containing section 3530*a* described above and supplies the toner T contained in the first toner containing section 3530*a* to the developing roller 3510. The toner supplying roller 3550 is made of, for example, polyurethane foam, and is made to abut against the developing roller 3510 in an elastically deformed state. The toner supplying roller 3550 is arranged at a lower section of the toner containing section 3530. The toner T contained in the toner containing sections 3530 is supplied to the developing roller 3510 by the toner supplying roller 3550 at the lower section of the toner containing section 3530.

The toner supplying roller 3550 is rotatable about its central axis. The central axis of the toner supplying roller 3550 is situated below the central axis of rotation of the developing roller 3510. Further, the toner supplying roller 3550 rotates in the opposite direction (clockwise in FIG. 21) to the rotating direction of the developing roller 3510 (counterclockwise in FIG. 21). It should be noted that the toner supplying roller 3550 has the function of supplying the toner T contained in the toner containing section 3530 to the developing roller 3510 as well as the function of stripping off, from the developing roller 3510, the toner T remaining on the developing roller 3510 after development.

The upper seal 3520 abuts against the developing roller 3510 along the axial direction thereof, and prevents the toner T in the yellow developing unit 3054 from spilling out therefrom, and also collects the toner T, which is on the developing roller 3510 that has passed the developing position, into the developing device without scraping it off. The upper seal 3520 is a seal made of, for example, polyethylene film. The upper seal 3520 is supported by an upper-seal-supporting metal plate 3660 of the holder 3620 described below, and is arranged such that the longitudinal direction of the upper seal 3520 is in the axial direction of the developing roller 3510.

A seal-urging member 3524 made of, for example, Moltoprene is provided on one side of the upper seal 3520 opposite from the side of the developing roller 3510. The upper seal 3520 is pressed against the developing roller 3510 by the elastic force of the seal-urging member 3524. Further, the abutting position at which the upper seal 3520 abuts against the developing roller 3510 is located above the central axis of the developing roller 3510.

The restriction blade 3560 abuts against the developing roller 3510 along the axial direction thereof, and gives an electric charge to the toner T borne by the developing roller 3510 as well as restricts the thickness of the layer of the toner T borne by the developing roller 3510. The restriction blade 3560 includes a rubber section 3561, which is an example of an abutting section, and a rubber-supporting section 3562, which is an example of an abutment-supporting section. The rubber section 3561 is made of, for example, silicone rubber or urethane rubber. The rubber-supporting section 3562 is a thin plate that is made of, for example, phosphor bronze or stainless steel, and that has a spring-like characteristic. The rubber section 3561 is supported by the rubber-supporting section 3562. The rubber-supporting section 3562 is supported at one end, in the lateral direction, by a blade-supporting metal plate 3630 of the holder 3620.

Further, a housing seal 3570 made of, for example, Moltoprene is provided on one side of the restriction blade 3560 opposite from the side of the developing roller 3510. The rubber section 3561 is pressed against the developing roller 3510 by the elastic force caused by the flexure of the rubber-supporting section 3562. Further, the housing seal 3570 prevents the toner T from entering in between the rubber-supporting section 3562 and the housing 3540, stabilizes the elastic force caused by the flexure of the rubber-supporting section 3562, and also, applies force to the rubber section 3561 from the back thereof towards the developing roller 3510 to press the rubber section 3561 against the developing roller 3510. In this way, the housing seal 3570 makes the rubber section 3561 abut against the developing roller 3510 more evenly.

The end of the restricting blade 3560 opposite from the end that is being supported by the blade-supporting metal plate 3630, i.e., the tip end of the restriction blade 3560, is not placed in contact with the developing roller 3510; rather, a section at a predetermined distance from the tip end contacts, with some breadth, the developing roller 3510. That is, the restriction blade 3560 does not abut against the developing roller 3510 at its edge, but abuts against the roller 3510 near its central portion. Further, the restriction blade 3560 is arranged so that its tip end faces towards the upstream side of the rotating direction of the developing roller 3510, and thus, makes a so-called counter-abutment with respect to the roller 3510. It should be noted that the abutting position at which the restriction blade 3560 abuts against the developing roller 3510 is below the central axis of the developing roller 3510 and is also below the central axis of the toner supplying roller 3550.

<Operation of Developing Unit>

In the yellow developing unit 3054 structured as above, the toner supplying roller 3550 supplies the toner T contained in the toner containing section 3530 to the developing roller 3510. With the rotation of the developing roller 3510, the toner T, which has been supplied to the developing roller 3510, reaches the abutting position of the restriction blade 3560; then, as the toner T passes the abutting position, the toner is electrically charged and its layer thickness is restricted.

With further rotation of the developing roller 3510, the toner T on the developing roller 3510 whose layer thickness has been restricted reaches the developing position opposing the photoconductor 20; then, under the alternating field, the toner T is used at the developing position for developing the latent image formed on the photoconductor 20.

With further rotation of the developing roller 3510, the toner T on the developing roller 3510, which has passed the developing position, passes the upper seal 3520 and is collected into the developing unit by the upper seal 3520 without being scraped off. Then, the toner T that still remains on the developing roller 3510 can be stripped off by the toner supplying roller 3550.

===(3) Configuration of Holder Unit etc.===

Figure 22:
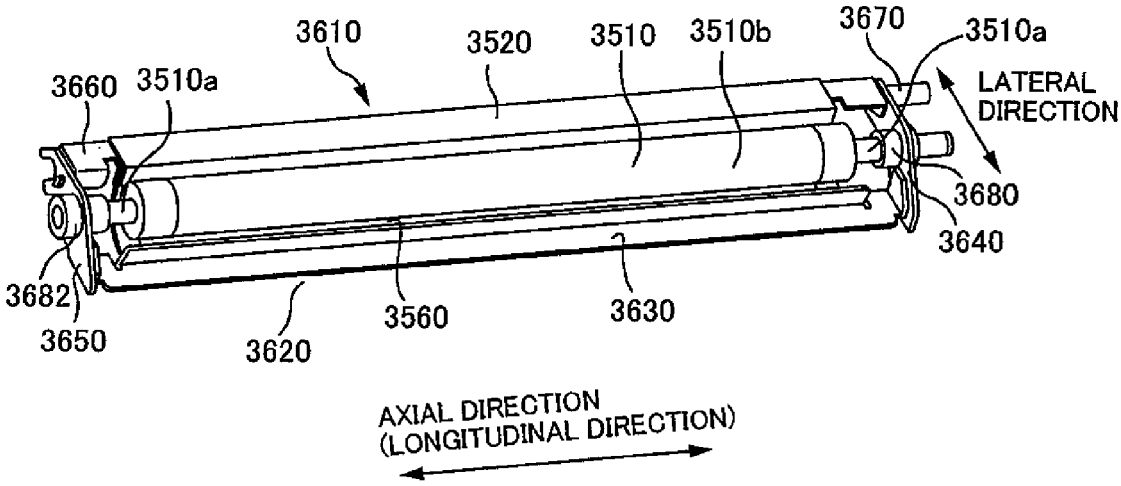
FIG. 22 is a perspective view of a holder unit 3610 according to the third embodiment.
Figure 23:
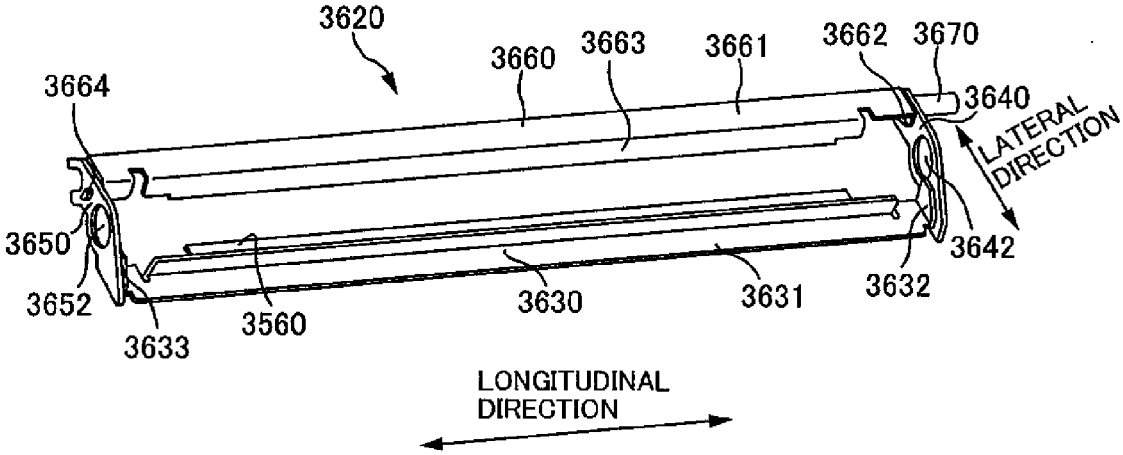
FIG. 23 is a perspective view of a holder 3620 according to the third embodiment.
Figure 24A:
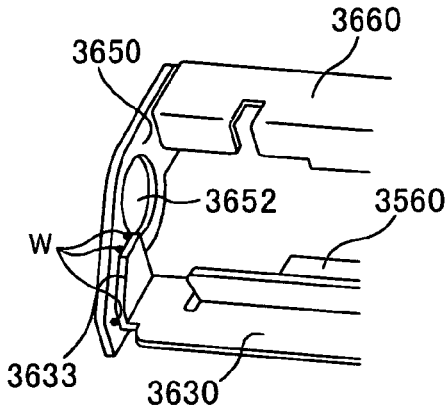
FIG. 24A shows the state of connection between the blade-supporting metal plate 3630 and the second side metal plate 3650.
Figure 24B:
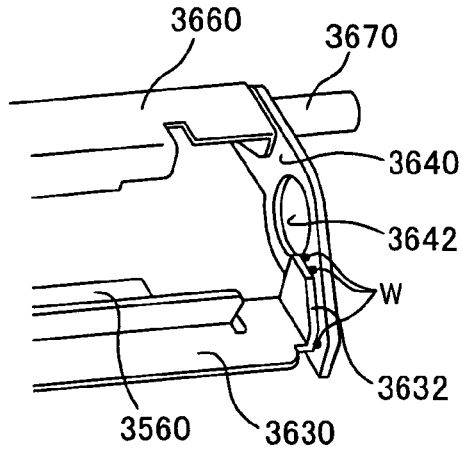
FIG. 24B shows the state of connection between the blade-supporting metal plate 3630 and the first side metal plate 3640.
Figure 24C:
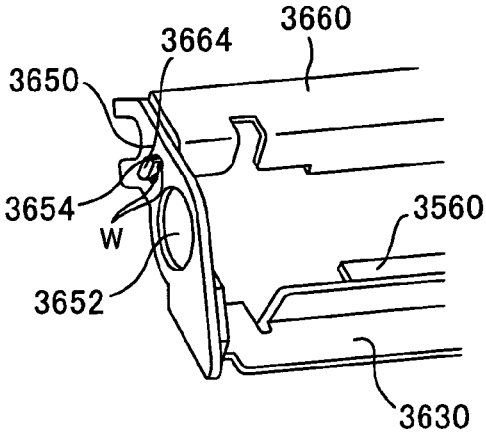
FIG. 24C shows a state of connection between the upper-seal-supporting metal plate 3660 and the second side metal plate 3650.
Figure 24D:
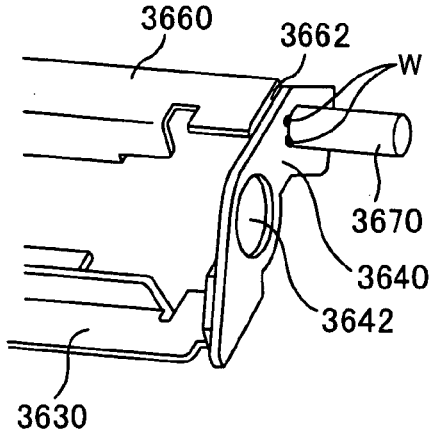
FIG. 24D shows the state of connection between the upper-seal-supporting metal plate 3660 and the first side metal plate 3640.
Figure 25:
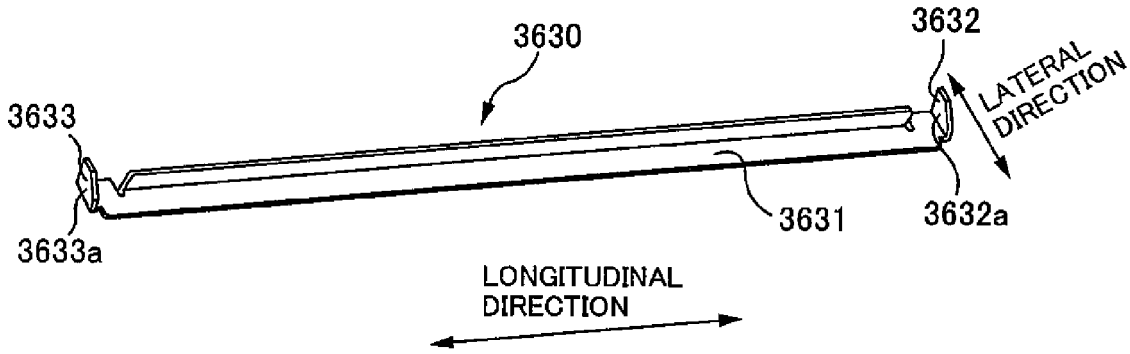
FIG. 25 is a perspective view of the blade-supporting metal plate 3630 according to the third embodiment.
Figure 26:
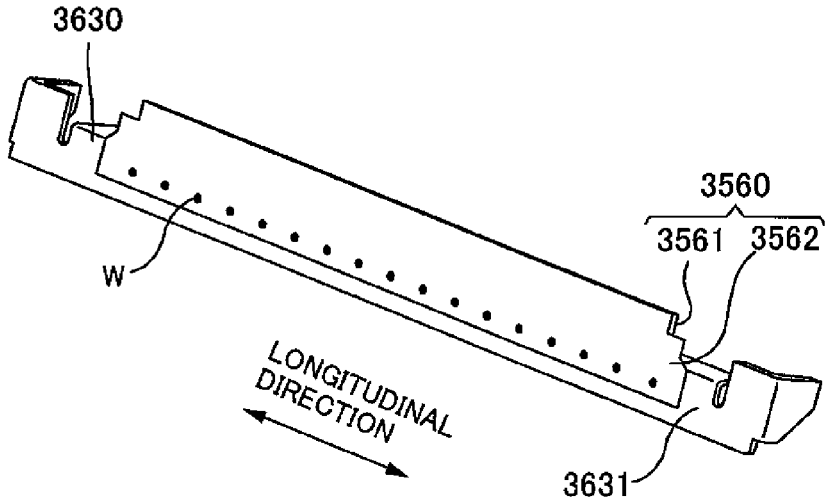
FIG. 26 is a perspective view showing a state in which the restriction blade 3560 is supported by the blade-supporting metal plate 3630 according to the third embodiment.

Next, the configuration of the holder unit 3610 according to the present third embodiment is described with reference to FIG. 22, FIG. 23, FIG. 24A, FIG. 24B, FIG. 24C, FIG. 24D, FIG. 25, and FIG. 26. FIG. 22 is a perspective view of a holder unit 3610. FIG. 23 is a perspective view of a holder 3620. FIG. 24A shows the state of connection between the blade-supporting metal plate 3630 and the second side metal plate 3650, FIG. 24B shows the state of connection between the blade-supporting metal plate 3630 and the first side metal plate 3640, FIG. 24C shows a state of connection between the upper-seal-supporting metal plate 3660 and the second side metal plate 3650, and FIG. 24D shows the state of connection between the upper-seal-supporting metal plate 3660 and the first side metal plate 3640. FIG. 25 is a perspective view of the blade-supporting metal plate 3630. FIG. 26 is a perspective view showing a state in which the restriction blade 3560 is supported by the blade-supporting metal plate 3630.

As shown in FIG. 22, the holder unit 3610 is structured of, for example, the developing roller 3510, the upper seal 3520, the restriction blade 3560, and a holder 3620 that supports them. As shown in FIG. 23, the holder 3620 is structured by connecting a first side metal plate 3640 which is made of metal and is an example of a one-end supporting member, a second side metal plate 3650 which is made of metal and is an example of an other-end supporting member, a blade-supporting metal plate 3630 which is made of metal and is an example of a charge-supporting member, and a upper-seal-supporting metal plate 3660 which is made of metal and is an example of a seal-supporting member. It should be noted that the first side metal plate 3640 and the second side metal plate 3650 are an example of a bearing-roller-supporting member.

The longitudinal direction of the first side metal plate 3640 is arranged in the lateral direction of the holder 3620 (i.e., the direction intersecting with the axial direction of the developing roller 3510), and rotatably supports one end, in the axial direction, of the developing roller 3510. The first side metal plate 3640 has a bearing hole 3642, which is an example of a roller-supporting hole, and a supporting-shaft hole (not shown) into which the supporting shaft 3670 for supporting the gear (not shown) is fitted. As shown in FIG. 22, the shaft section 3510*a* on the side of one end of the developing roller 3510 is supported, through the bearing 3680, by the bearing hole 3642 in a state where the bearing hole 3642 and the bearing 3680 mate with one another.

The longitudinal direction of the second side metal plate 3650 is arranged in the lateral direction of the holder 3620 (i.e., the direction intersecting with the axial direction of the developing roller 3510), and rotatably supports the other end, in the axial direction, of the developing roller 3510. The second side metal plate 3650 has a bearing hole 3652, which is an example of a roller-supporting hole, and a hole 3654. As shown in FIG. 22, the shaft section 3510*a* on the side of the other end of the developing roller 3510 is supported, through the bearing 3682, by the bearing hole 3652 in a state where the bearing hole 3652 and the bearing 3682 mate with one another. The hole 3654 mates with a projection 3664 provided on the upper-seal-supporting metal plate 3660.

The longitudinal direction of the blade-supporting metal plate 3630 is arranged in the longitudinal direction of the holder 3620 (i.e., the axial direction of the developing roller 3510), and supports the restriction blade 3560. As shown in FIG. 25, the blade-supporting metal plate 3630 has a blade-supporting section 3631, and a first bent section 3632 and a second bent section 3633 that have been bent at both ends in the longitudinal direction (which are an example of sections that have been bent at both ends of a charge-supporting member).

The blade-supporting section 3631 supports the rubber-supporting section 3562 of the restriction blade 3560. As shown in FIG. 26, the blade-supporting section 3631 and one end, in the lateral direction, of the rubber-supporting section 3562 are welded together through laser spot welding (the dots indicated by W in FIG. 26), and in this way, the restriction blade 3560 is supported by the blade-supporting metal plate 3630.

As shown in FIG. 25, a bent surface 3632*a* is formed in the first bent section 3632. As shown in FIG. 24B, the bent surface 3632*a* and the first side metal plate 3640 are welded through laser spot welding (the dots indicated by W in FIG. 24B) in a state where the bent surface 3632*a* and the first side metal plate 3640 are in contact with one another, and in this way, the blade-supporting metal plate 3630 and the first side metal plate 3640 are connected.

As shown in FIG. 25, a bent surface 3633*a* is formed in the second bent section 3633. As shown in FIG. 24A, the bent surface 3633*a* and the second side metal plate 3650 are welded through laser spot welding (the dots indicated by W in FIG. 24A) in a state where the bent surface 3633*a* and the second side metal plate 3650 are in contact with one another, and in this way, the blade-supporting metal plate 3630 and the second side metal plate 3650 are connected.

The longitudinal direction of the upper-seal-supporting metal plate 3660 is arranged in the longitudinal direction of the holder 3620 (i.e., the axial direction of the developing roller 3510), and supports the upper seal 3520. The upper-seal-supporting metal plate 3660 has an upper-seal supporting section 3661, a first bent section 3662 formed by bending one end in the longitudinal direction of the metal plate 3660, and a second bent section 3663 formed by bending the metal plate 3660 along its longitudinal direction. The upper-seal supporting section 3661 supports one end, in the lateral direction, of the upper seal 3520 (see FIG. 21).

The first bent section 3662 is provided with a screw hole (not shown) that mates with a male screw (not shown) formed on the supporting shaft 3670. As shown in FIG. 24D, the male screw of the supporting shaft 3670 is fitted into the screw hole of the first bent section 3662, and in this way, the upper-seal-supporting metal plate 3660 and the supporting shaft 3670 are connected. Further, as shown in FIG. 24D, the circumferential surface of the supporting shaft 3670 and the first side metal plate 3640 are welded through laser spot welding (the dots indicated by W in FIG. 24D), and in this way, the supporting shaft 3670 and the first side metal plate 3640 are connected. Thus, the upper-seal-supporting metal plate 3660 and the first side metal plate 3640 are connected via the supporting shaft 3670.

The seal-urging member 3524 (see FIG. 21) is fixed to the second bent section 3663. Further, a projection 3664 that fits into the hole 3654 is provided on the second bent section 3663 at the other end, in the longitudinal direction, of the upper-seal-supporting metal plate 3660. As shown in FIG. 24C, the projection 3664 and the second side metal plate 3650 are welded through laser spot welding (the dots indicated by W in FIG. 24C) in a state where the projection 3664 is fitted into the hole 3654, and in this way, the upper-seal-supporting metal plate 3660 and the second side metal plate 3650 are connected.

===(3) Adjustment of the Attachment Position===

Figure 27:
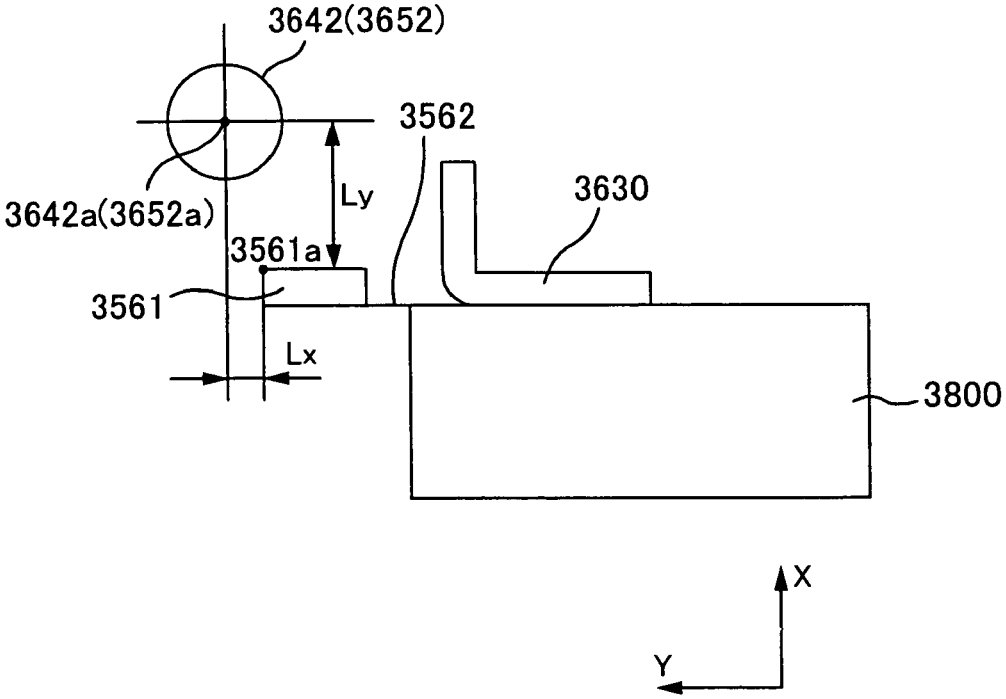
FIG. 27 is a schematic diagram for describing how the attachment position is adjusted according to the third embodiment.

Next, adjustment of the attachment position of the blade-supporting metal plate 3630 with respect to the first side metal plate 3640 and the second side metal plate 3650 is described with reference to FIG. 27. FIG. 27 is a schematic diagram for describing how the attachment position is adjusted.

In order to charge the toner T borne by the developing roller 3510 evenly, it is necessary to arrange the restriction blade 3560 in an appropriate position with respect to the developing roller 3510. In order to arrange the restriction blade 3560 in an appropriate position with respect to the developing roller 3510, it is necessary to arrange the blade-supporting metal plate 3630, which supports the restriction blade 3560, in the most suitable position with respect to the first side metal plate 3640 and the second side metal plate 3650, which support the developing roller 3510.

In view of this, the attachment position of the blade-supporting metal plate 3630 with respect to the first side metal plate 3640 and the second side metal plate 3650 is adjusted by adjusting the distance between the bearing hole 3642 of the first side metal plate 3640 (or the bearing hole 3652 of the second side metal plate 3650) and the restriction blade 3560.

More specifically, as shown in FIG. 27, the attachment position is adjusted by moving a jig 3800 that supports the blade-supporting metal plate 3630, on which the restriction blade 3560 is supported, with respect to the first side metal plate 3640 (or the second side metal plate 3650) supported at a certain position using a jig etc., such that the distance between the edge 3561*a* of the rubber section 3561 and the center 3642*a* of the bearing hole 3642 of the first side metal plate 3640 (or the center 3652*a* of the bearing hole 3652 of the second side metal plate 3650) takes a predetermined value (Lx in the X direction and Ly in the Y direction).

===(3) Method of Assembling the Holder 3620===

Figure 28:
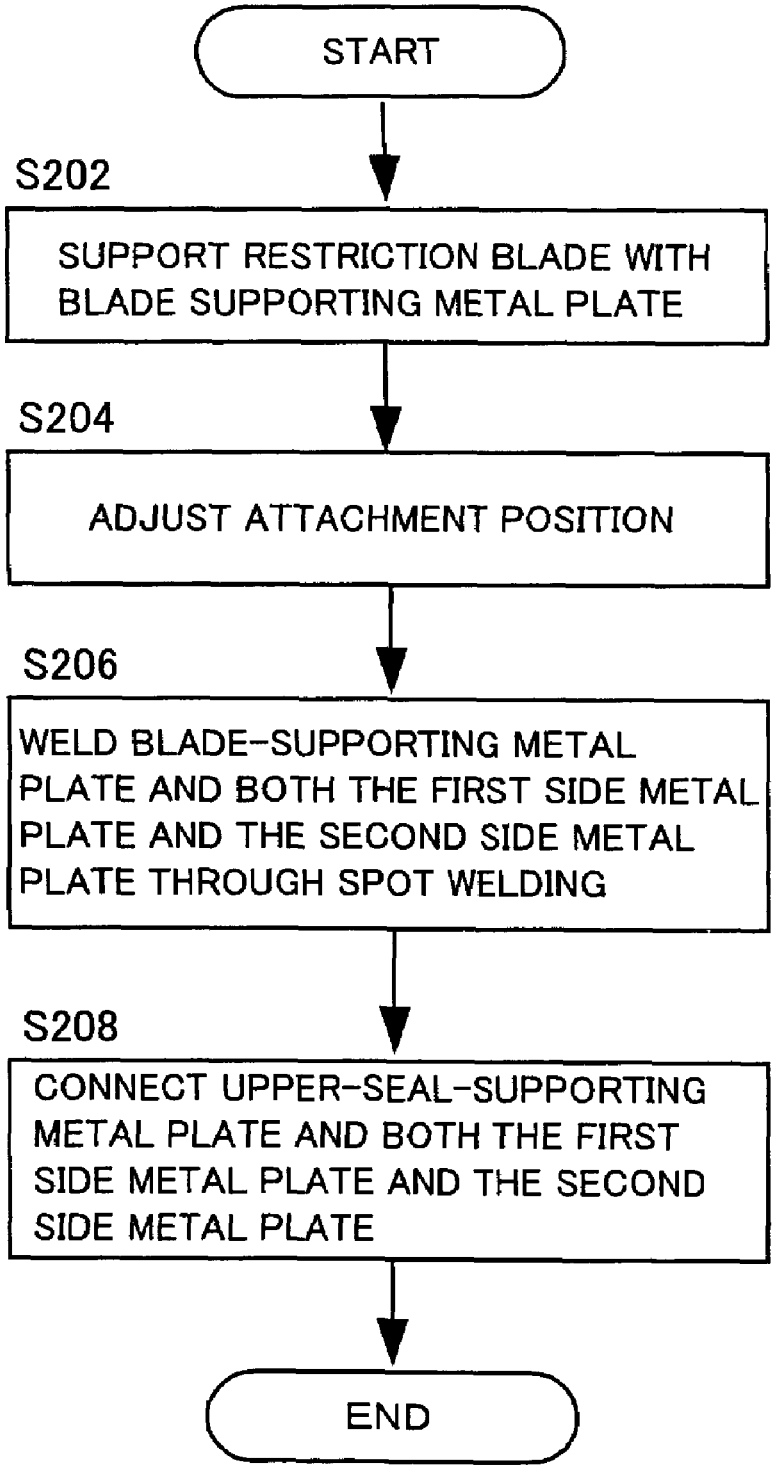
FIG. 28 is a flowchart showing a method of assembling the holder 3620 according to the third embodiment.

Next, the method of assembling the holder 3620 is described with reference to FIG. 28. FIG. 28 is a flowchart showing a method of assembling the holder 3620.

First, the blade-supporting metal plate 3630 is made to support the restriction blade 3560 (step S202). More specifically, as shown in FIG. 26, the blade-supporting metal plate 3630 is made to support the restriction blade 3560 by welding one end, in the lateral direction, of the rubber-supporting section 3562 and the blade-supporting section 3631 through laser spot welding (the dots indicated by W in FIG. 26).

Next, the attachment position of the blade-supporting metal plate 3630 with respect to the first side metal plate 3640 and the second side metal plate 3650 is adjusted (step S204). More specifically, as shown in FIG. 27, the attachment position of the blade-supporting metal plate 3630 with respect to the first side metal plate 3640 and the second side metal plate 3650 is adjusted such that the distance between the edge 3561*a* of the rubber section 3561 and the center 3642*a* (3652*a*) of the bearing hole 3642 (3652) takes a predetermined value (Lx in the X direction and Ly in the Y direction).

Next, the blade-supporting metal plate 3630 is welded through spot welding to both the first side metal plate 3640 and the second side metal plate 3650 (step S206). More specifically, as shown in FIG. 24A and FIG. 24B, the first bent section 3632 and the first side metal plate 3640, and also the second bent section 3633 and the second side metal plate 3650, are welded together through laser spot welding (the dots indicated by W in FIG. 24A and FIG. 24B) in a state where the first bent section 3632 is in contact with the first side metal plate 3640 and the second bent section 3633 is in contact with the second side metal plate 3650.

Next, the upper-seal-supporting metal plate 3660 is connected to both the first side metal plate 3640 and the second side metal plate 3650 (step S208). More specifically, as shown in FIG. 24C and FIG. 24D, the upper-seal-supporting metal plate 3660 is connected to both the first side metal plate 3640 and the second side metal plate 3650 by welding together the projection 3664 and the second side metal plate 3650, and also the circumferential surface of the supporting shaft 3670 and the first side metal plate 3640, through laser spot welding (the dots indicated by W in FIG. 24C and FIG. 24D) in a state where the projection 3664 is fitted into the hole 3654 and the male screw of the supporting shaft 3670 is fitted into the screw hole of the first bent section 3632.

In this way, it is possible to assemble a holder 3620 in which the blade-supporting metal plate 3630 is arranged in an appropriate position with respect to the first side metal plate 3640 and the second side metal plate 3650.

===(3) Effect of Welding the Developing-roller-supporting Metal Plate and the Blade-supporting Metal Plate Through Spot Welding===

In the present embodiment, the first side metal plate 3640 and the second side metal plate 3650 (which are the bearing-roller-supporting member) and the blade-supporting metal plate 3630 (which is the charge-supporting member) are welded together through spot welding (the dots indicated by W in FIG. 24A and FIG. 24B). In this way, it becomes possible to arrange the restriction blade 3560 in an appropriate position with respect to the developing roller 3510. This is described in detail below.

Figure 29:
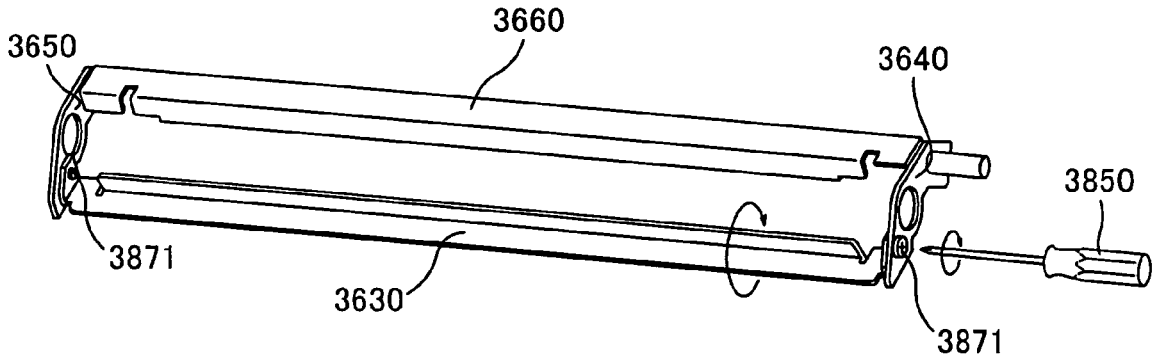
FIG. 29 is a diagram for describing a comparative example of the third embodiment.

First, a comparative example is described with reference to FIG. 29. FIG. 29 is a diagram for describing a comparative example. In this comparative example, the blade-supporting metal plate 3630 is fastened to both the first side metal plate 3640 and the second side metal plate 3650 with screws 3871.

As shown in FIG. 29, when fastening the blade-supporting metal plate 3630 and the first side metal plate 3640 using a screw 3871, the screw 3871 is turned in the direction indicated in FIG. 29 using a driver 3850. In this case, the blade-supporting metal plate 3630 may also turn in the direction indicated in FIG. 29 due to the turning force for causing the screw 3871 to turn. Therefore, the position of the blade-supporting metal plate 3630 with respect to the first side metal plate 3640 may deviate from its proper position. Further, also when fastening the blade-supporting metal plate 3630 and the second side metal plate 3650 using a screw 3871, the position of the blade-supporting metal plate 3630 with respect to the second side metal plate 3650 may deviate from its proper position due to the reason described above.

As described above, the position of the blade-supporting metal plate 3630 with respect to the first side metal plate 3640 and/or the second side metal plate 3650 may deviate from its proper position due to the turning force etc. applied from the driver 3850 to make the screw 3871 turn in the case of fastening the blade-supporting metal plate 3630 and both the first side metal plate 3640 and the second side metal plate 3650 using screws 3871. If the position of the blade-supporting metal plate 3630 with respect to the first side metal plate 3640 and/or the second side metal plate 3650 deviates from its proper position, then the position of the restriction blade 3560 with respect to the developing roller 3510 may also deviate.

On the other hand, according to the present embodiment, as shown in FIG. 24A and FIG. 24B, the first bent section 3632 of the blade-supporting metal plate 3630 and the first side metal plate 3640, and also the second bent section 3633 of the blade-supporting metal plate 3630 and the second side metal plate 3650, are connected through laser spot welding (the dots indicated by W in FIG. 24A and FIG. 24B) which is one type of spot welding. In this case, no turning force is necessary, and therefore, there is no possibility that the blade-supporting metal plate 3630 may turn. Therefore, it is possible to prevent the position of the blade-supporting metal plate 3630 with respect to the first side metal plate 3640 and/or the second side metal plate 3650 from deviating from its proper position. In this way, it becomes possible to arrange the restriction blade 3560 in an appropriate position with respect to the developing roller 3510.

===(3) Other Considerations===

The foregoing embodiment relates to a developing unit (developing device) 51, 52, 53, or 3054 comprising: a restriction blade 3560 (developer charging member) for charging a toner T (developer) borne by a developing roller 3510 (developer bearing roller); a first side metal plate 3640 and a second side metal plate 3650 (bearing-roller-supporting members) that are made of metal and that are for rotatably supporting the developing roller 3510; and a blade-supporting metal plate 3630 (charge-supporting member) that is made of metal and that is for supporting the restriction blade 3560.

Further, in the foregoing embodiment, laser spot welding was adopted as the spot welding, as shown in FIG. 24A and FIG. 24B. This, however, is not a limitation. For example, spot welding other than laser spot welding may be employed.

However, when laser spot welding is adopted, since it is possible to control the intensity of the laser beam and the irradiation time easily and therefore keep unnecessary heat from being applied to the first side metal plate 3640 and the second side metal plate 3650 and the blade-supporting metal plate 3630, deformation of the first side metal plate 3640 and the second side metal plate 3650 and the blade-supporting metal plate 3630 due to heat can be inhibited. Thus, it becomes possible to prevent the deviation in position of the restriction blade 3560 with respect to the developing roller 3510 more effectively. The foregoing embodiment is therefore more preferable in this sense.

Further, in the foregoing embodiment, as shown in FIG. 27, an attachment position where the blade-supporting metal plate 3630 is attached to the first side metal plate 3640 and the second side metal plate 3650 was adjusted, and after adjusting the attachment position, the blade-supporting metal plate 3630 and the first side metal plate 3640 and the second side metal plate 3650 were welded through laser spot welding. This, however, is not a limitation.

However, by welding the blade-supporting metal plate 3630 and the first side metal plate 3640 and the second side metal plate 3650 through laser spot welding after adjusting the attachment position thereof, it is possible to prevent the position of the blade-supporting metal plate 3630 with respect to the first side metal plate 3640 and the second side metal plate 3650 from deviating after the attachment position has been adjusted, and therefore arrange the restriction blade 3560 in a more appropriate position with respect to the developing roller 3510. The foregoing embodiment is therefore more preferable in this sense.

Further, in the foregoing embodiment, the bearing-roller-supporting member included a first side metal plate 3640 (one-end supporting member) for rotatably supporting one end, in an axial direction, of the developing roller 3510, and a second side metal plate 3650 (other-end supporting member) for rotatably supporting an other end, in the axial direction, of the developing roller 3510; the blade-supporting metal plate 3630 was provided such that a longitudinal direction thereof is arranged in the axial direction of the developing roller 3510; and as shown in FIG. 24A and FIG. 24B, the blade-supporting metal plate 3630 and both the first side metal plate 3640 and the second side metal plate 3650 were welded through laser spot welding. This, however, is not a limitation. For example, the bearing-roller-supporting member may be a member obtained by forming the first side metal plate 3640, the second side metal plate 3650, and the upper-seal-supporting metal plate 3660 into a unit.

Further, in the foregoing embodiment, both ends (i.e., the first bent section 3632 and the second bent section 3633), in the longitudinal direction, of the blade-supporting metal plate 3630 were bent; and as shown in FIG. 24A and FIG. 24B, the first bent section 3632 and the second bent section 3633 were welded, respectively, through laser spot welding to the first side metal plate 3640 and the second side metal plate 3650 in a state where the first bent section 3632 and the second bent section 3633 are placed in contact, respectively, with the first side metal plate 3640 and the second side metal plate 3650. This, however, is not a limitation. For example, both ends, in the longitudinal direction, of the blade-supporting metal plate 3630 do not have to be bent, but instead, bent sections may be provided in the first side metal plate 3640 and the second side metal plate 3650, and these bent sections may be welded to the blade-supporting metal plate 3630 through laser spot welding.

However, when the first bent section 3632 and the second bent section 3633 are formed in the blade-supporting metal plate 3630, and the first bent section 3632 and the first side metal plate 3640, as well as the second bent section 3633 and the second side metal plate 3650, are fastened together with a screw, the position of the blade-supporting metal plate 3630 with respect to the first side metal plate 3640 and the second side metal plate 3650 is more likely to deviate from its proper position due to the turning force etc. for causing the screw to turn. In such a case, the effect of the present invention, i.e., the effect of allowing the restriction blade 3560 to be arranged in an appropriate position with respect to the developing roller 3510, is achieved more advantageously. The foregoing embodiment is therefore more preferable in this sense.

Further, in the foregoing embodiment, the restriction blade 3560 was provided with a rubber section 3561 (abutting section) that abuts against the developing roller 3510 as shown in FIG. 21. This, however, is not a limitation. For example, the restriction blade 3560 does not have to abut against the developing roller 3510.

However, if the rubber section 3561 is provided on the restriction blade 3560, it is necessary to arrange the abutting section in an appropriate position with respect to the developing roller 3510 to make the electric charge of the toner T on the developing roller 3510 even. In such a case, the effect of the present invention, i.e., the effect of allowing the restriction blade 3560 to be arranged in an appropriate position with respect to the developing roller 3510, is achieved more advantageously. The foregoing embodiment is therefore more preferable in this sense.

Further, in the foregoing embodiment, the restriction blade 3560 was provided with a rubber-supporting section 3562 (abutment-supporting section) whose one end, in a lateral direction, is supported by the blade-supporting metal plate 3630 and whose other end is for supporting the rubber section 3561; and as shown in FIG. 26, the rubber-supporting section 3562 and the blade-supporting metal plate 3630 were welded through laser spot welding. This, however, is not a limitation. For example, the rubber-supporting section 3562 may be supported by the blade-supporting metal plate 3630 without being welded through spot welding.

However, if the rubber-supporting section 3562 and the blade-supporting metal plate 3630 are welded through laser spot welding, then since the first side metal plate 3640 and the second side metal plate 3650 and the blade-supporting metal plate 3630, as well as the rubber-supporting section 3562 and the blade-supporting metal plate 3630, are welded through the same laser spot welding technique, the burden of changing the method for welding can be eliminated, and therefore, it becomes possible to improve the workability during manufacturing. The foregoing embodiment is therefore more preferable in this sense.

Further, in the foregoing embodiment, the developing device had an upper-seal-supporting metal plate 3660 (seal-supporting member) for supporting an upper seal 3520 (sealing member) that prevents the toner T from spilling from between the developing roller 3510 and a housing 3540 that contains the toner T; and as shown in FIG. 24C and FIG. 24D, the upper-seal-supporting metal plate 3660 and both the first side metal plate 3640 and the second side metal plate 3650 were welded through laser spot welding. This, however, is not a limitation. For example, the upper-seal-supporting metal plate 3660 may be connected to the first side metal plate 3640 and the second side metal plate 3650 without being welded through spot welding.

However, if the upper-seal-supporting metal plate 3660 and both the first side metal plate 3640 and the second side metal plate 3650 are connected through laser spot welding, then since the blade-supporting metal plate 3630 and the upper-seal-supporting metal plate 3660 are connected to both the first side metal plate 3640 and the second side metal plate 3650 through laser spot welding, it becomes possible to increase the strength of the holder 3620 when connecting the first side metal plate 3640, the second side metal plate 3650, the blade-supporting metal plate 3630, and the upper-seal-supporting metal plate 3660. The foregoing embodiment is therefore more preferable in this sense.

Further, in the foregoing embodiment, the adjustment of the attachment position of the blade-supporting metal plate 3630 with respect to the first side metal plate 3640 and the second side metal plate 3650 was carried out such that the distance between the edge 3561*a* of the rubber section 3561 and the center 3642*a* of the bearing hole 3642 of the first side metal plate 3640 (or the center 3652*a* of the bearing hole 3652 of the second side metal plate 3650) takes a predetermined value (Lx in the X direction and Ly in the Y direction) as shown in FIG. 27. This, however, is not a limitation. For example, the attachment position may be adjusted such that the distance between the edge of the rubber section 3561 and the central axis of the developing roller 3510 takes a predetermined value in a state where the rubber section 3561 is made to abut against the developing roller 3510.

However, if the attachment position is adjusted such that the distance between the edge 3561*a* of the rubber section 3561 and the center 3642*a* of the bearing hole 3642 (or the center 3652*a* of the bearing hole 3652) takes a predetermined value (Lx in the X direction and Ly in the Y direction), then it becomes possible to arrange the blade-supporting metal plate 3630 in an appropriate position with respect to the first side metal plate 3640 and the second side metal plate 3650 at a higher precision, compared to adjusting the attachment position in a state where the rubber section 3561 is made to abut against the developing roller 3510. The foregoing embodiment is therefore more preferable in this sense.

Figure 30:
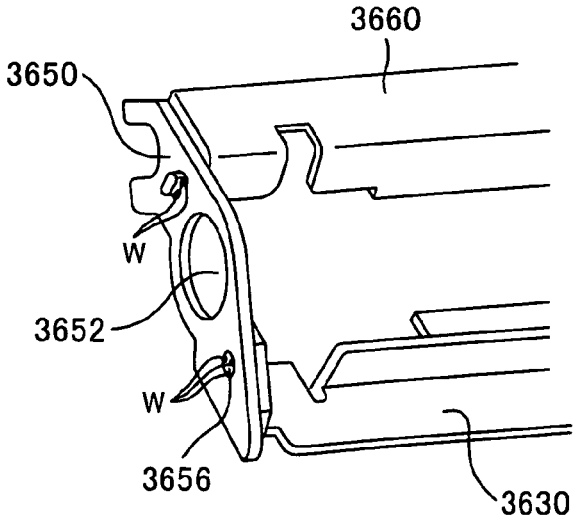
FIG. 30 is a diagram showing another example of the third embodiment.

Further, the positions where the first bent section 3632 of the blade-supporting metal plate 3630 and the first side metal plate 3640, and also the second bent section 3633 of the blade-supporting metal plate 3630 and the second side metal plate 3650, are welded through laser spot welding are not limited to those positions shown in FIG. 24A and FIG. 24B. For example, as shown in FIG. 30, a welding hole 3656 may be provided in the second side metal plate 3650, and the welding hole 3656 and the bent surface 3633*a* of the second bent section 3633 may be welded through laser spot welding (the dots indicated by W in FIG. 30). It should be noted that FIG. 30 is a diagram showing another example. Further, the first side metal plate 3640 and the bent surface 3632*a* may also be welded through laser spot welding at a similar position as that described above.

<<<Other Embodiments>>>

In the foregoing, an image forming apparatus etc. of the present invention was described according to embodiments thereof. However, the foregoing embodiments of the invention are for the purpose of elucidating the present invention and are not to be interpreted as limiting the present invention. The present invention can be altered and improved without departing from the gist thereof, and needless to say, the present invention includes its equivalents.

In the foregoing embodiments, an intermediate transferring type full-color laser beam printer was described as an example of the image forming apparatus, but the present invention is also applicable to various types of image forming apparatuses, such as full-color laser beam printers that are not of the intermediate transferring type, monochrome laser beam printers, copying machines, and facsimile machines.

Further, in the foregoing embodiments, an image forming apparatus provided with a rotary-type developing device was described as an example. This, however, is not a limitation, and the present invention is applicable to, for example, image forming apparatuses provided with tandem-type developing devices.

Further, in the foregoing embodiments, the photoconductor, as an image bearing body, was described as having a structure in which a photoconductive layer was provided on the outer peripheral surface of a cylindrical, conductive base. This, however, is not a limitation. The photoconductor can be, for example, a so-called photoconductive belt structured by providing a photoconductive layer on a surface of a belt-like conductive base.

<<<Configuration of Image Forming System Etc.>>>

Next, an embodiment of an image forming system, which serve as an example of an embodiment of the present invention, is described with reference to the FIG. 31 and FIG. 32.

Figure 31:
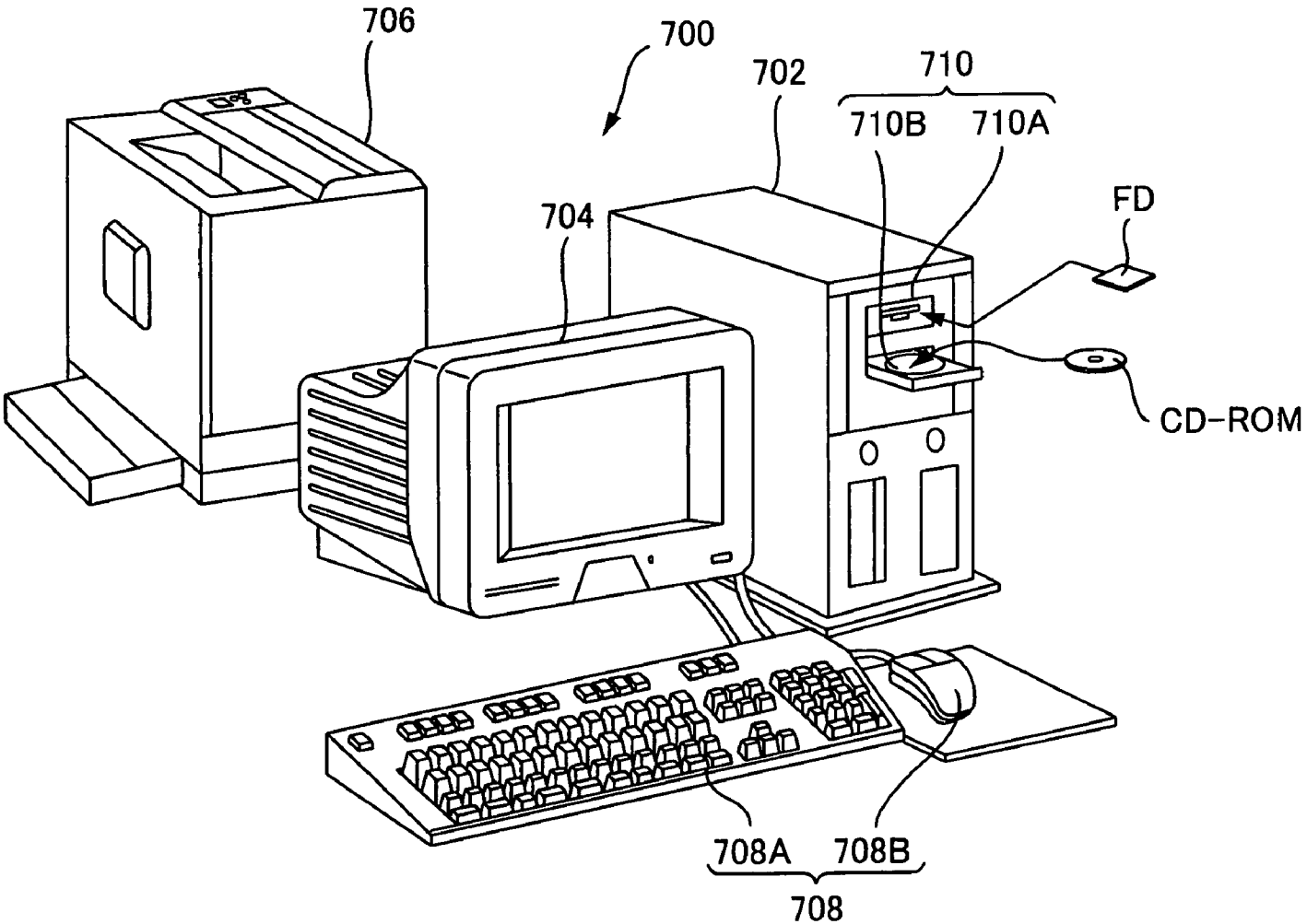
FIG. 31 is an explanatory drawing showing an external structure of an image forming system.

FIG. 31 is an explanatory drawing showing an external structure of an image forming system. The image forming system 700 comprises a computer 702, a display device 704, a printer 706, an input device 708, and a reading device 710.

In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 32:
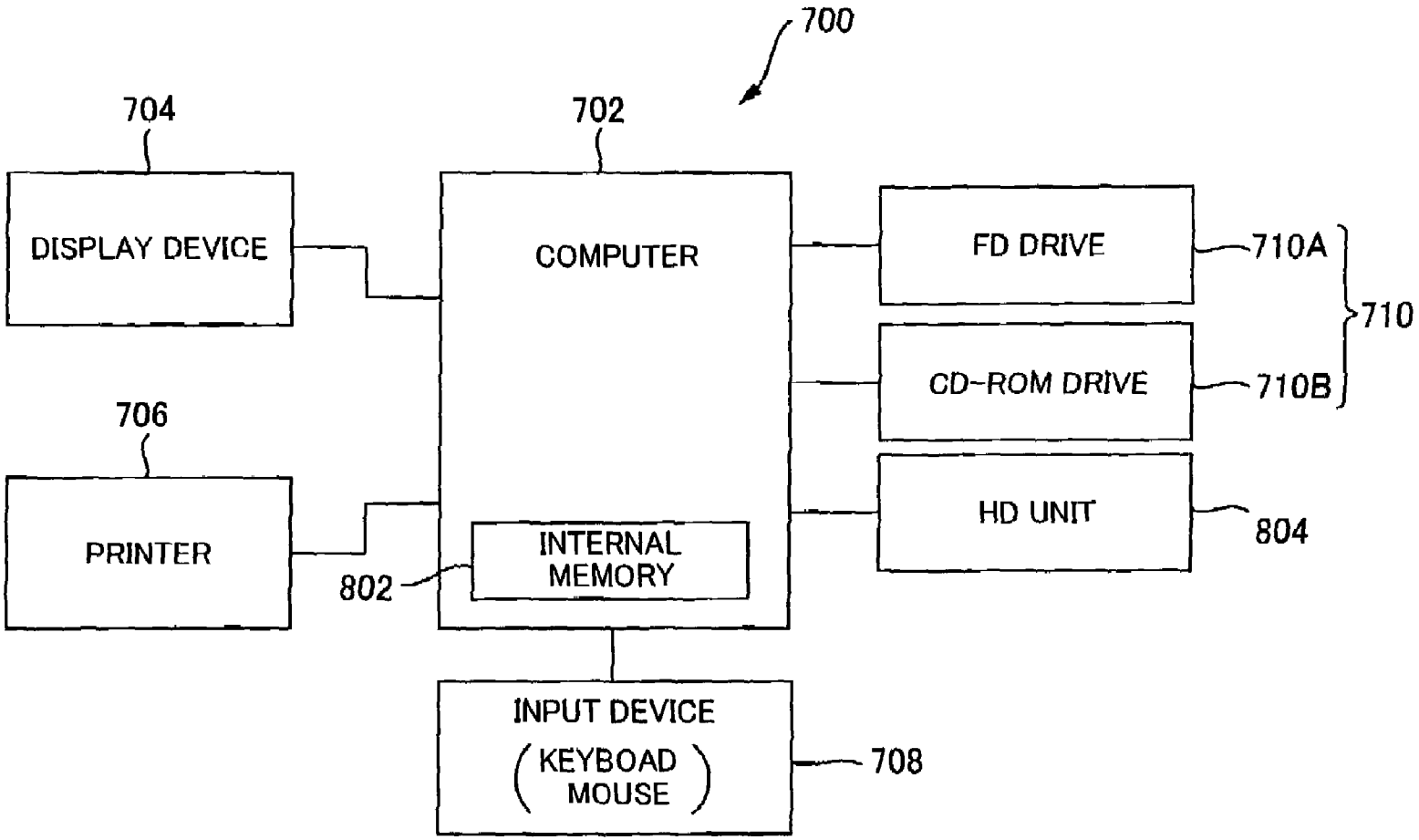
FIG. 32 is a block diagram showing a configuration of the image forming system shown in FIG. 31.

FIG. 32 is a block diagram showing a configuration of the image forming system shown in FIG. 31. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to comprise any one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. A developing device comprising:

a developer containing section that is for containing a developer and that has a predetermined coefficient of thermal expansion;

a developing roller for bearing the developer contained in said developer containing section;

a roller-supporting member that is for rotatably supporting said developing roller, that has a coefficient of thermal expansion which is different from the coefficient of thermal expansion of said developer containing section, and that is structured by connecting at least three members; and a gap for preventing said roller-supporting member and said developer containing section from interfering with one another when said roller-supporting member and said developer containing section expand/contract due to a change in temperature.

2. A developing device according to claim 1, wherein, when said at least three members are connected to structure said roller-supporting member, a state of connection among said members is adjusted such that said roller-supporting member has a predetermined size.

3. A developing device according to claim 1, wherein said roller-supporting member is mounted to said developer containing section such that a longitudinal direction of said roller-supporting member is arranged in a longitudinal direction of said developer containing section; and wherein said developing device has the gap for preventing said roller-supporting member and said developer containing section from interfering with one another when said roller-supporting member and said developer containing section expand/contract in their longitudinal direction due to a change in temperature.

4. A developing device according to claim 3, wherein said roller-supporting member is structured by connecting together the following four members:

a first supporting member that is arranged in a lateral direction intersecting with said longitudinal direction of said roller-supporting member and that is for supporting one end of said developing roller, a second supporting member that is arranged in said lateral direction and that is for supporting the other end of said developing roller, and a first longitudinal member and a second longitudinal member that are each connected to both said first supporting member and said second supporting member and that are arranged in said longitudinal direction.

5. A developing device according to claim 4, wherein said developing device has a restriction blade for restricting a thickness of a layer of the developer borne by said developing roller; and wherein said second longitudinal member is a blade-supporting member for supporting said restriction blade.

6. A developing device according to claim 5, wherein, when connecting said four members, a state of connection of said first supporting member and said second supporting member with respect to said blade-supporting member is adjusted.

7. A developing device according to claim 4, wherein a roller gear for rotating said developing roller with a drive force transmitted from a drive source is provided on said one end of said developing roller; and wherein said gap exists between a side surface of said second supporting member that intersects with said longitudinal direction, and an opposition surface of said developer containing section that is in opposition to said side surface.

8. A developing device according to claim 7, wherein said second longitudinal member and said first supporting member are connected with a screw, said second longitudinal member and said second supporting member are connected with a screw, and said first supporting member and said first longitudinal member are connected with a screw; and wherein said second supporting member and first longitudinal member are not connected with a screw.

9. A developing device according to claim 8, wherein a projection is provided at an end of said first longitudinal member that is connected to said second supporting member;

wherein a hole is provided in said second supporting member; and wherein said projection is fitted into said hole.

10. A developing device according to claim 1, wherein said developer containing section is made of resin, and said roller-supporting member is made of metal.

11. A developing device comprising:

a developer containing section that is for containing a developer and that has a predetermined coefficient of thermal expansion;

a developing roller for bearing the developer contained in said developer containing section;

a roller-supporting member that is for rotatably supporting said developing roller, that has a coefficient of thermal expansion which is different from the coefficient of thermal expansion of said developer containing section, and that is structured by connecting at least three members; and a gap for preventing said roller-supporting member and said developer containing section from interfering with one another when said roller-supporting member and said developer containing section expand/contract due to a change in temperature;

wherein, when said at least three members are connected to structure said roller-supporting member, a state of connection among said members is adjusted such that said roller-supporting member has a predetermined size;

wherein said roller-supporting member is mounted to said developer containing section such that a longitudinal direction of said roller-supporting member is arranged in a longitudinal direction of said developer containing section;

wherein said developing device has the gap for preventing said roller-supporting member and said developer containing section from interfering with one another when said roller-supporting member and said developer containing section expand/contract in their longitudinal direction due to a change in temperature;

wherein said roller-supporting member is structured by connecting together the following four members:

a first supporting member that is arranged in a lateral direction intersecting with said longitudinal direction of said roller-supporting member and that is for supporting one end of said developing roller, a second supporting member that is arranged in said lateral direction and that is for supporting the other end of said developing roller, and a first longitudinal member and a second longitudinal member that are each connected to both said first supporting member and said second supporting member and that are arranged in said longitudinal direction;

wherein said developing device has a restriction blade for restricting a thickness of a layer of the developer borne by said developing roller;

wherein said second longitudinal member is a blade-supporting member for supporting said restriction blade;

wherein, when connecting said four members, a state of connection of said first supporting member and said second supporting member with respect to said blade-supporting member is adjusted;

wherein a roller gear for rotating said developing roller with a drive force transmitted from a drive source is provided on said one end of said developing roller;

wherein said gap exists between a side surface of said second supporting member that intersects with said longitudinal direction, and an opposition surface of said developer containing section that is in opposition to said side surface;

wherein said second longitudinal member and said first supporting member are connected with a screw, said second longitudinal member and said second supporting member are connected with a screw, and said first supporting member and said first longitudinal member are connected with a screw;

wherein said second supporting member and first longitudinal member are not connected with a screw;

wherein a projection is provided at an end of said first longitudinal member that is connected to said second supporting member;

wherein a hole is provided in said second supporting member;

wherein said projection is fitted into said hole; and wherein said developer containing section is made of resin, and said roller-supporting member is made of metal.

12. An image forming apparatus comprising:

an image bearing body for bearing a latent image; and a developing device provided with:

a developer containing section that is for containing a developer and that has a predetermined coefficient of thermal expansion;

a developing roller for bearing the developer contained in said developer containing section, the developer borne by said developing roller being used to develop the latent image borne by said image bearing body;

a roller-supporting member that is for rotatably supporting said developing roller, that has a coefficient of thermal expansion which is different from the coefficient of thermal expansion of said developer containing section, and that is structured by connecting at least three members; and a gap for preventing said roller-supporting member and said developer containing section from interfering with one another when said roller-supporting member and said developer containing section expand/contract due to a change in temperature.

13. An image forming system comprising:

a computer; and an image forming apparatus that is connectable to said computer and that has an image bearing body for bearing a latent image, and a developing device provided with:

a developer containing section that is for containing a developer and that has a predetermined coefficient of thermal expansion;

a developing roller for bearing the developer contained in said developer containing section, the developer borne by said developing roller being used to develop the latent image borne by said image bearing body;

a roller-supporting member that is for rotatably supporting said developing roller, that has a coefficient of thermal expansion which is different from the coefficient of thermal expansion of said developer containing section, and that is structured by connecting at least three members; and a gap for preventing said roller-supporting member and said developer containing section from interfering with one another when said roller-supporting member and said developer containing section expand/contract due to a change in temperature.

14. A method of manufacturing a developing device that is provided with: a developer containing section that is for containing a developer and that has a predetermined coefficient of thermal expansion; a developing roller for bearing the developer contained in said developer containing section; a roller-supporting member that is for rotatably supporting said developing roller and that has a coefficient of thermal expansion which is different from the coefficient of thermal expansion of said developer containing section; and a gap for preventing said roller-supporting member and said developer containing section from interfering with one another when said roller-supporting member and said developer containing section expand/contract due to a change in temperature, said method comprising:

preparing at least three members for structuring said roller-supporting member; and connecting said at least three members while adjusting a state of connection among said at least three members such that said roller-supporting member has a predetermined size.

15. A developing device comprising:

a developing roller for bearing a developer;

a roller-supporting member that is structured by connecting at least two members and that is for rotatably supporting said developing roller;

a roller gear that is provided at one end of said developing roller and that is for rotating said developing roller;

an intermediate gear for transmitting a drive force from a drive source to said roller gear; and a gear-supporting shaft for rotatably supporting said intermediate gear, a screw section of said gear-supporting shaft connecting said at least two members that structure said roller-supporting member.

16. A developing device according to claim 15, wherein one of said two members is a one-end supporting member for rotatably supporting, through a bearing, the one end of said developing roller; and wherein said one-end supporting member is provided with a shaft hole for mating with said gear-supporting shaft and a bearing hole for mating with said bearing.

17. A developing device according to claim 16,
wherein said intermediate gear meshes with said roller gear.

18. A developing device according to claim 16,
wherein said two members are:
said one-end supporting member, and
a longitudinal member that is arranged in a longitudinal direction of said developing roller and that is connected to said one-end supporting member;
wherein said gear-supporting shaft is provided with:
a first shaft section for rotatably supporting said intermediate gear,
a second shaft section whose diameter is smaller than a diameter of said first shaft section, and
said screw section whose diameter is smaller than the diameter of said second shaft section and on which a male screw is formed;
wherein said longitudinal member has a female screw formed therein; and
wherein said one-end supporting member and said longitudinal member are connected by fitting said male screw into said female screw in a state where said second shaft section is fitted into said shaft hole.

19. A developing device according to claim 18,
wherein said intermediate gear rotates in a predetermined direction; and
wherein a winding direction of a thread of said male screw is arranged in such a direction that said one-end supporting member and said Longitudinal member are tightened together when said gear-supporting shaft is rotated in said predetermined direction.

20. A developing device according to claim 18,
wherein said developing device has:
a developer containing section for containing a developer, and
a sealing member that abuts against said developing roller and that is for preventing the developer from spilling from between said developing roller and said developer containing section; and
wherein said sealing member is supported by said longitudinal member.

21. A developing device according to claim 18,
wherein said roller-supporting member is structured by connecting together the following four members:
said one-end supporting member,
an other-end supporting member for rotatably supporting, through a hearing, an other end of said developing roller, and
said longitudinal member and a second longitudinal member that are each connected to both said one-end supporting member and said other-end supporting member and that are arranged in said longitudinal direction.

22. A developing device comprising:
a developing roller for bearing a developer;
a roller-supporting member that is structured by connecting at least two members and that is for rotatably supporting said developing roller;
a roller gear that is provided at one end of said developing roller and that is for rotating said developing roller;
an intermediate gear for transmitting a drive force from a drive source to said roller gear; and
a gear-supporting shaft for rotatably supporting said intermediate gear, a screw section of said gear-supporting shaft connecting said at least two members that structure said roller-supporting member;
wherein one of said two members is a one-end supporting member for rotatably supporting, through a bearing, the one end of said developing roller;
wherein said one-end supporting member is provided with a shaft hole for mating with said gear-supporting shaft and a bearing hole for mating with said bearing;
wherein said intermediate gear meshes with said roller gear;
wherein said two members are:
said one-end supporting member, and
a longitudinal member that is arranged in a longitudinal direction of said developing roller and that is connected to said one-end supporting member;
wherein said gear-supporting shaft is provided with:
a first shaft section for rotatably supporting said intermediate gear,
a second shaft section whose diameter is smaller than a diameter of said first shaft section, and
said screw section whose diameter is smaller than the diameter of said second shaft section and on which a male screw is formed;
wherein said longitudinal member has a female screw formed therein;
wherein said one-end supporting member and said longitudinal member are connected by fitting said male screw into said female screw in a state where said second shaft section is fitted into said shaft hole;
wherein said intermediate gear rotates in a predetermined direction;
wherein a winding direction of a thread of said male screw is arranged in such a direction that said one-end supporting member and said longitudinal member are tightened together when said gear-supporting shaft is rotated in said predetermined direction;
wherein said developing device has:
a developer containing section for containing a developer, and
a sealing member that abuts against said developing roller and that is for preventing the developer from spilling from between said developing roller and said developer containing section;
wherein said sealing member is supported by said longitudinal member; and
wherein said roller-supporting member is structured by connecting together the following four members:
said one-end supporting member,
an other-end supporting member for rotatably supporting, through a bearing, an other end of said developing roller, and
said longitudinal member and a second longitudinal member that are each connected to both said one-end supporting member and said other-end supporting member and that are arranged in said longitudinal direction.

23. An image forming apparatus comprising:
an image bearing body for bearing a latent image; and
a developing device provided with:
a developing roller for bearing a developer, the developer borne by said developing roller being used to develop the latent image borne by said image bearing body;
a roller-supporting member that is structured by connecting at least two members and that is for rotatably supporting said developing roller;
a roller gear that is provided at one end of said developing roller and that is for rotating said developing roller;

an intermediate gear for transmitting a drive force from a drive source to said roller gear; and a gear-supporting shaft for rotatably supporting said intermediate gear, a screw section of said gear-supporting shaft connecting said at least two members that structure said roller-supporting member.

24. An image forming system comprising:

a computer; and an image forming apparatus that is connectable to said computer and that has an image bearing body for bearing a latent image, and a developing device provided with:

a developing roller for bearing a developer, the developer borne by said developing roller being used to develop the latent image borne by said image bearing body;

a roller-supporting member that is structured by connecting at least two members and that is for rotatably supporting said developing roller;

a roller gear that is provided at one end of said developing roller and that is for rotating said developing roller;

an intermediate gear for transmitting a drive force from a drive source to said roller gear; and a gear-supporting shaft for rotatably supporting said intermediate gear, a screw section of said gear-supporting shaft connecting said at least two members that structure said roller-supporting member.

* * * * *